US011795711B2

(12) United States Patent
Hashimoto et al.

(10) Patent No.: US 11,795,711 B2
(45) Date of Patent: Oct. 24, 2023

(54) BINDING MACHINE

(71) Applicant: MAX CO., LTD., Tokyo (JP)

(72) Inventors: Takahiro Hashimoto, Tokyo (JP); Norihiro Nagai, Tokyo (JP); Takahiro Ito, Tokyo (JP); Hikaru Mizukami, Tokyo (JP); Kozo Iwaki, Tokyo (JP)

(73) Assignee: MAX CO., LTD., Tokyo (JP)

( * ) Notice: Subject to any disclaimer, the term of this patent is extended or adjusted under 35 U.S.C. 154(b) by 37 days.

(21) Appl. No.: 17/361,786

(22) Filed: Jun. 29, 2021

(65) Prior Publication Data

US 2021/0404197 A1 Dec. 30, 2021

(30) Foreign Application Priority Data

Jun. 30, 2020 (JP) ..... 2020-113339

(51) Int. Cl.
*B21F 15/04* (2006.01)
*E04G 21/12* (2006.01)

(52) U.S. Cl.
CPC ..... *E04G 21/123* (2013.01); *B21F 15/04* (2013.01)

(58) Field of Classification Search
CPC ..... B21F 15/02; B21F 15/04; E04G 21/122; E04G 21/123; B65B 13/025; B65B 13/04; B65B 13/18
See application file for complete search history.

(56) References Cited

U.S. PATENT DOCUMENTS

| | | | | |
|---|---|---|---|---|
| 2005/0005991 | A1 | 1/2005 | Ishikawa et al. | |
| 2018/0148943 | A1* | 5/2018 | Itagaki | E04G 21/122 |
| 2018/0187434 | A1 | 7/2018 | Itagaki et al. | |
| 2019/0249447 | A1 | 8/2019 | Itagaki et al. | |
| 2020/0378140 | A1 | 12/2020 | Itagaki et al. | |
| 2021/0010282 | A1 | 1/2021 | Itagaki et al. | |

FOREIGN PATENT DOCUMENTS

| | | | |
|---|---|---|---|
| CN | 1539707 | A | 10/2004 |
| CN | 108327970 | A | 7/2018 |
| JP | H07-002201 | U | 1/1995 |
| JP | H11-227722 | A | 8/1999 |
| JP | 2001-018918 | A | 1/2001 |
| JP | 2002-211515 | A | 7/2002 |
| JP | 2003-064876 | A | 3/2003 |
| JP | 2004-001881 | A | 1/2004 |
| JP | 2018-109295 | A | 7/2018 |
| WO | 2017-014266 | A1 | 1/2017 |

* cited by examiner

*Primary Examiner* — Debra M Sullivan
(74) *Attorney, Agent, or Firm* — WEIHROUCH IP

(57) ABSTRACT

A binding machine includes: a feeding unit capable of feeding a wire and winding the wire around a to-be-bound object; and a function unit movable between a first position located on a feeding locus of the wire and a second position deviating from a position on the feeding locus of the wire. The function unit is located in the second position in a predetermined state.

6 Claims, 24 Drawing Sheets

BINDING MACHINE

CROSS-REFERENCE TO RELATED APPLICATIONS

This application claims priority to Japanese Patent Application No. 2020-113339 filed on Jun. 30, 2020, the content of which is incorporated herein by reference.

TECHNICAL FIELD

The present disclosure relates to a binding machine.

BACKGROUND ART

In the related art, used is a reinforced bar binding machine configured to wind a wire delivered from a feeding unit into a loop shape around reinforced bars by using a guide part such as a guide pin, and to grip and twist the wire by a binding unit including hooks, thereby winding and binding the reinforced bars with the wire (for example, refer to WO 2017/014266).

The reinforced bar binding machine includes a member configured to be movable between a position on a feeding locus of the wire and a position deviating from the feeding locus. Examples of the member include a guide pin and a retreat mechanism for curing the wire W, a twisting unit configured to grip and twist the wire, and the like.

However, in the reinforced bar binding machine of the related art, since a retreat mechanism and a returning part move onto the feeding locus of the wire, the wire may collide with the retreat mechanism and the returning part while feeding the wire. In this case, the wire may deviate from a conveying path, the wire may be jammed, the wire may be buckled, and the like, for example.

It is therefore an object of the present invention to provide a binding machine capable of preventing deviation of a wire from a conveying path, jam of the wire, buckling of the wire and the like due to a member capable of moving to a position on a feeding locus of the wire.

SUMMARY OF INVENTION

There is provided a binding machine that includes: a feeding unit capable of feeding a wire and winding the wire around a to-be-bound object; and a function unit movable between a first position located on a feeding locus of the wire and a second position deviating from a position on the feeding locus of the wire. The function unit is located in the second position in a predetermined state.

According to the present disclosure, since the function unit is located in the second position deviating from a position on the feeding locus, in the predetermined state, it is possible to remove the wire from the function unit even when problems of deviation of the wire from a conveying path, jam of the wire, buckling of the wire and the like occur.

DESCRIPTION OF EMBODIMENTS

Hereinafter, preferred embodiments of the present disclosure will be described with reference to the drawings.

First Embodiment (Configuration Example of Reinforced Bar Binding Machine 1A)

Figure 1A:
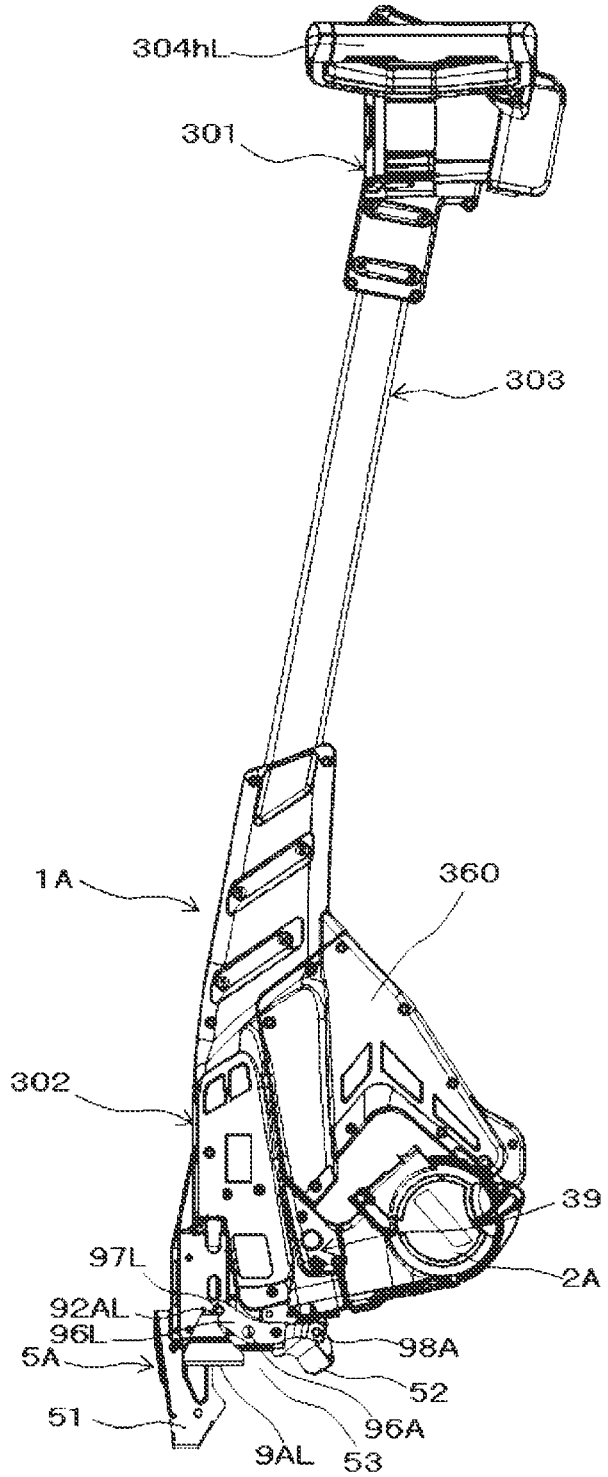
FIG. 1A is a side view of a reinforced bar binding machine of a first embodiment.
Figure 1B:
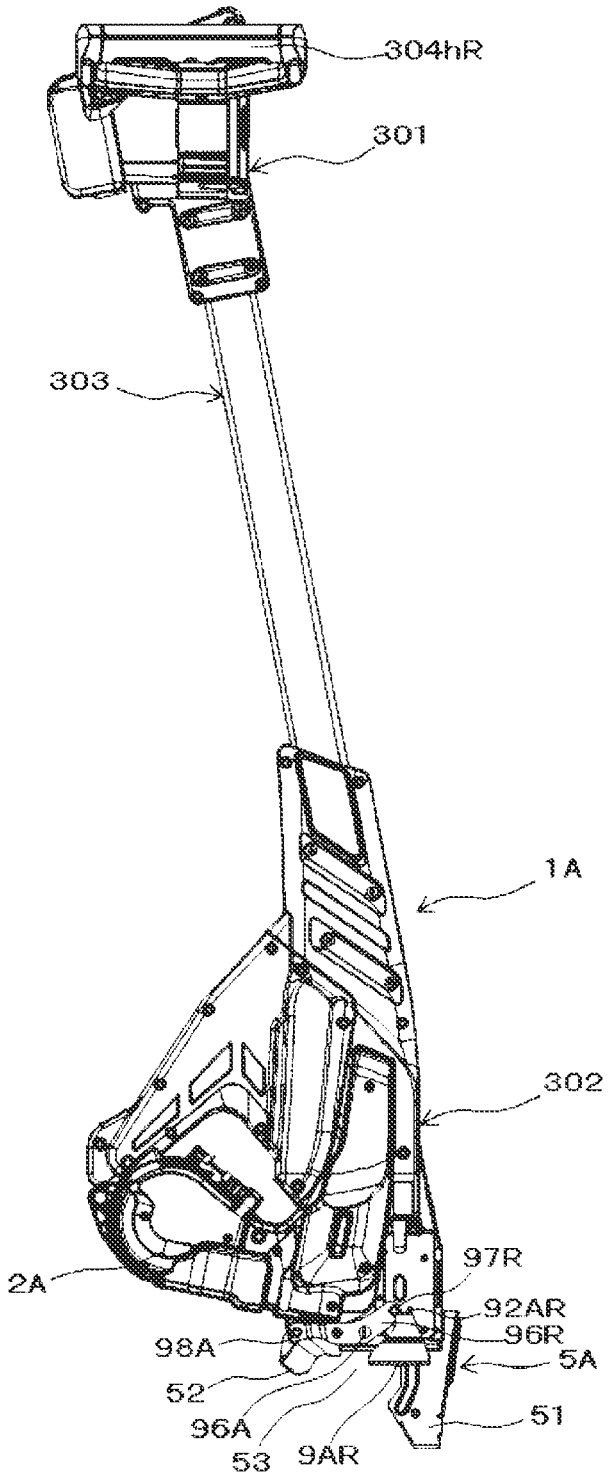
FIG. 1B is a side view of the reinforced bar binding machine of the first embodiment.
Figure 1C:
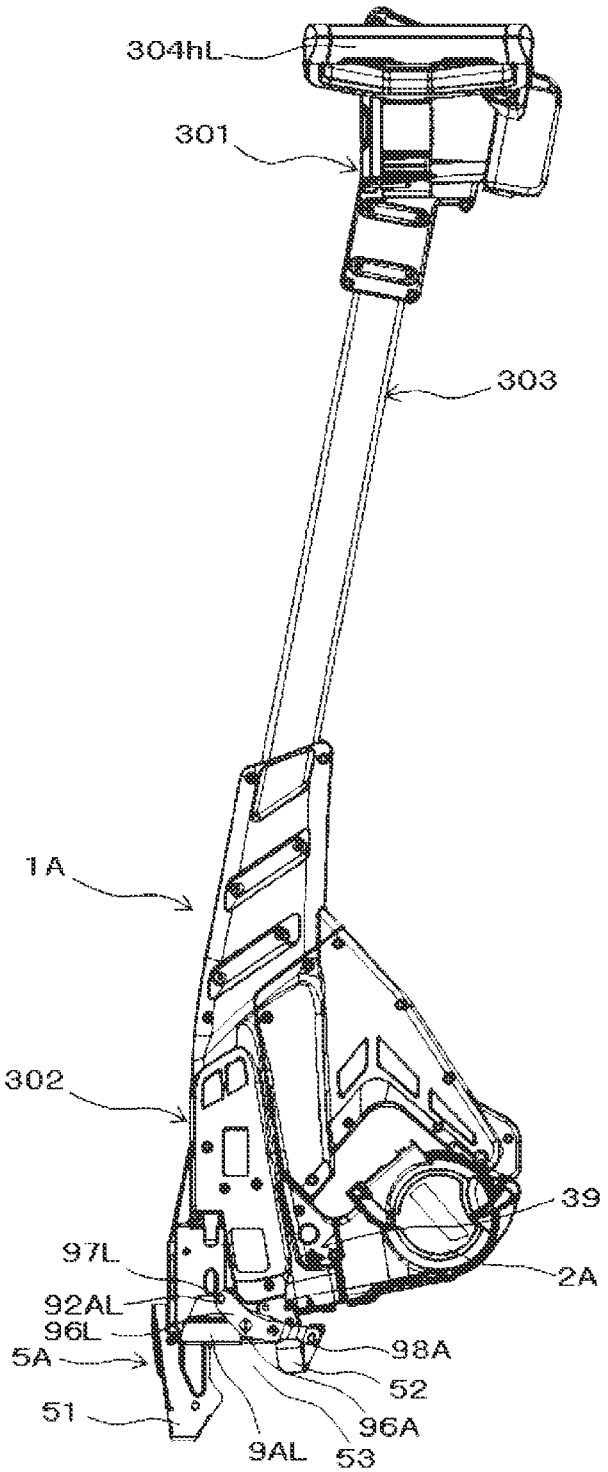
FIG. 1C is a side view of the reinforced bar binding machine of the first embodiment.
Figure 1D:
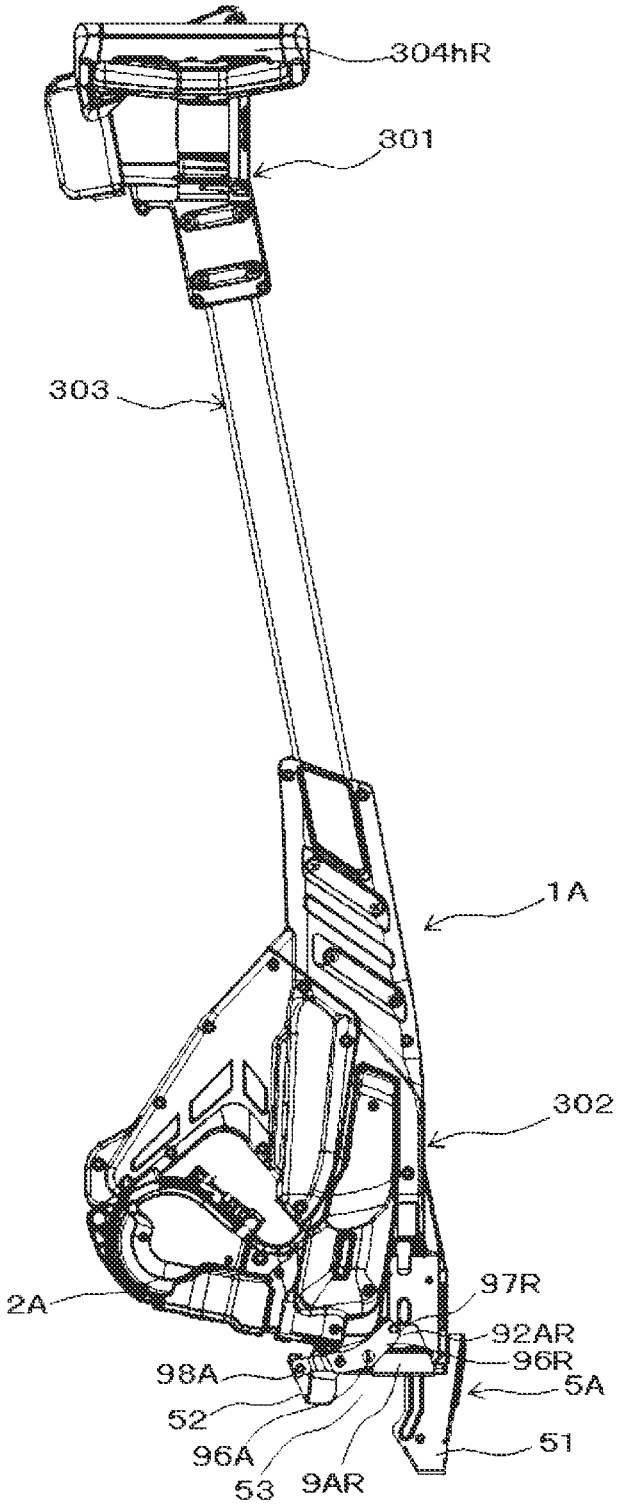
FIG. 1D is a side view of the reinforced bar binding machine of the first embodiment.
Figure 1E:
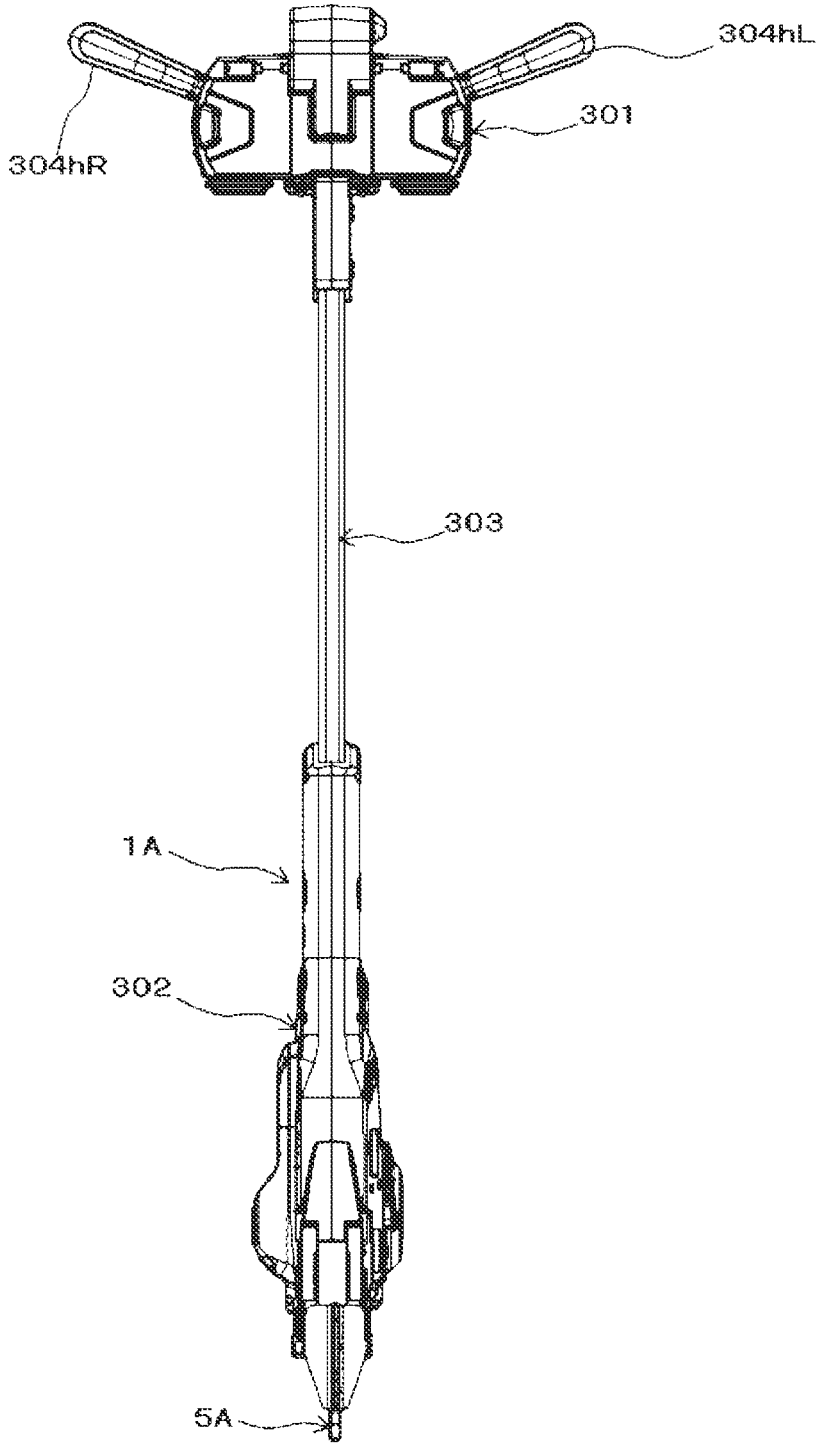
FIG. 1E is a top view of the reinforced bar binding machine of the first embodiment.
Figure 2A:
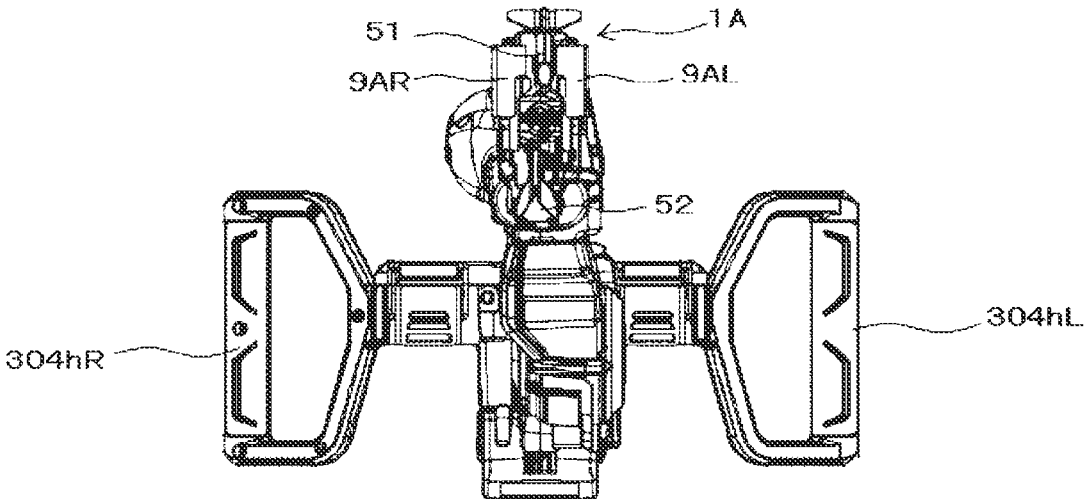
FIG. 2A is a front view of the reinforced bar binding machine of the first embodiment.
Figure 2B:
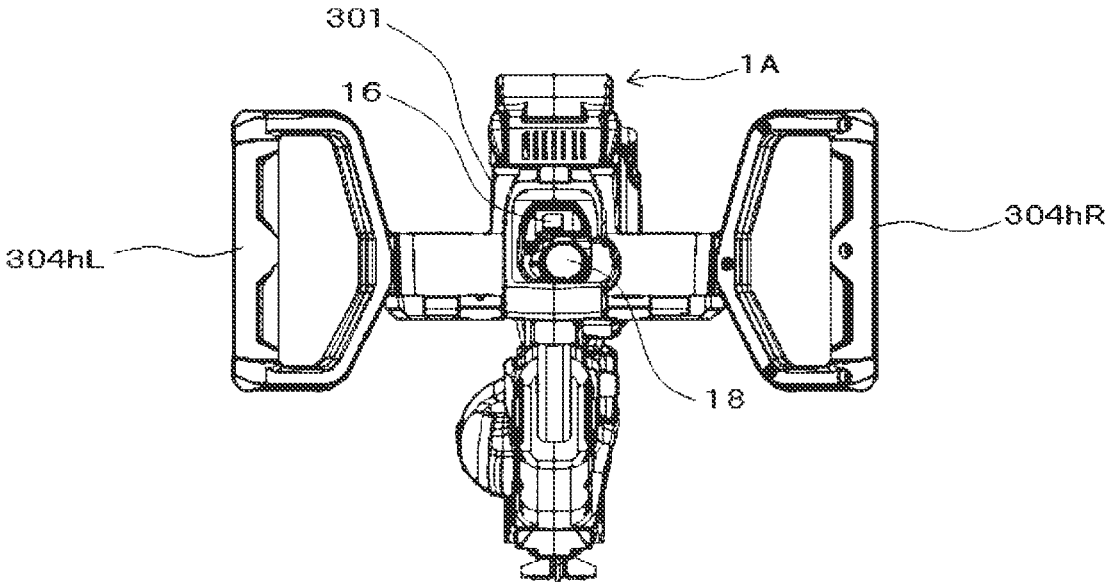
FIG. 2B is a rear view of the reinforced bar binding machine of the first embodiment.
Figure 3:
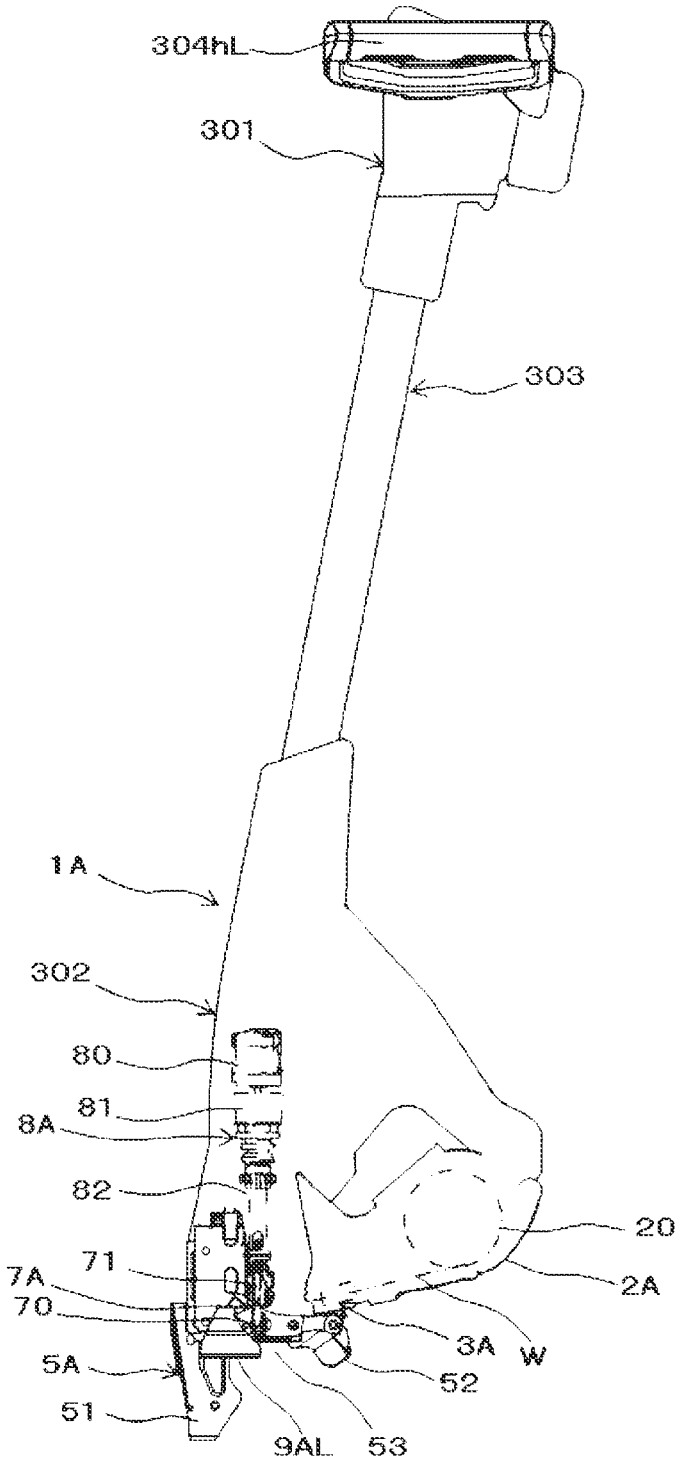
FIG. 3 is a side view showing an internal configuration of the reinforced bar binding machine of the first embodiment.
Figure 4A:
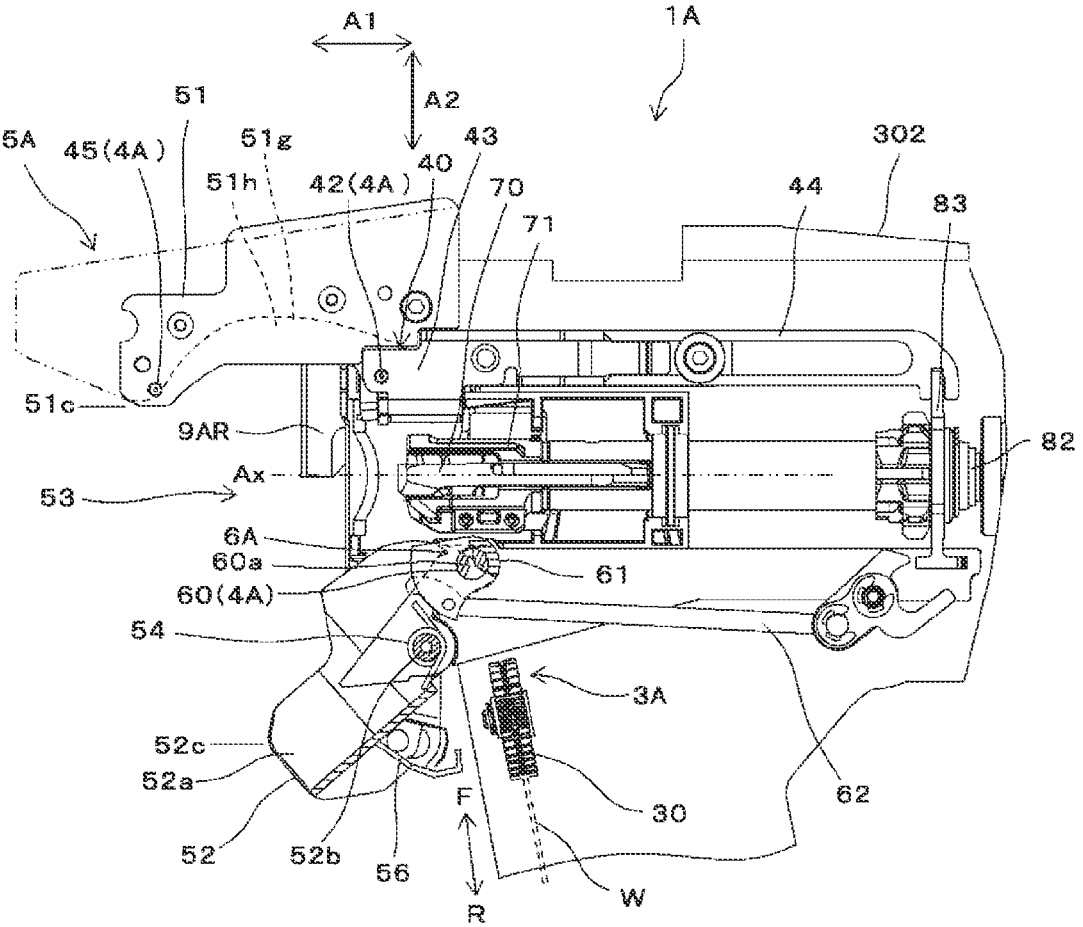
FIG. 4A is a side view showing an inside of the reinforced bar binding machine of the first embodiment.
Figure 4B:
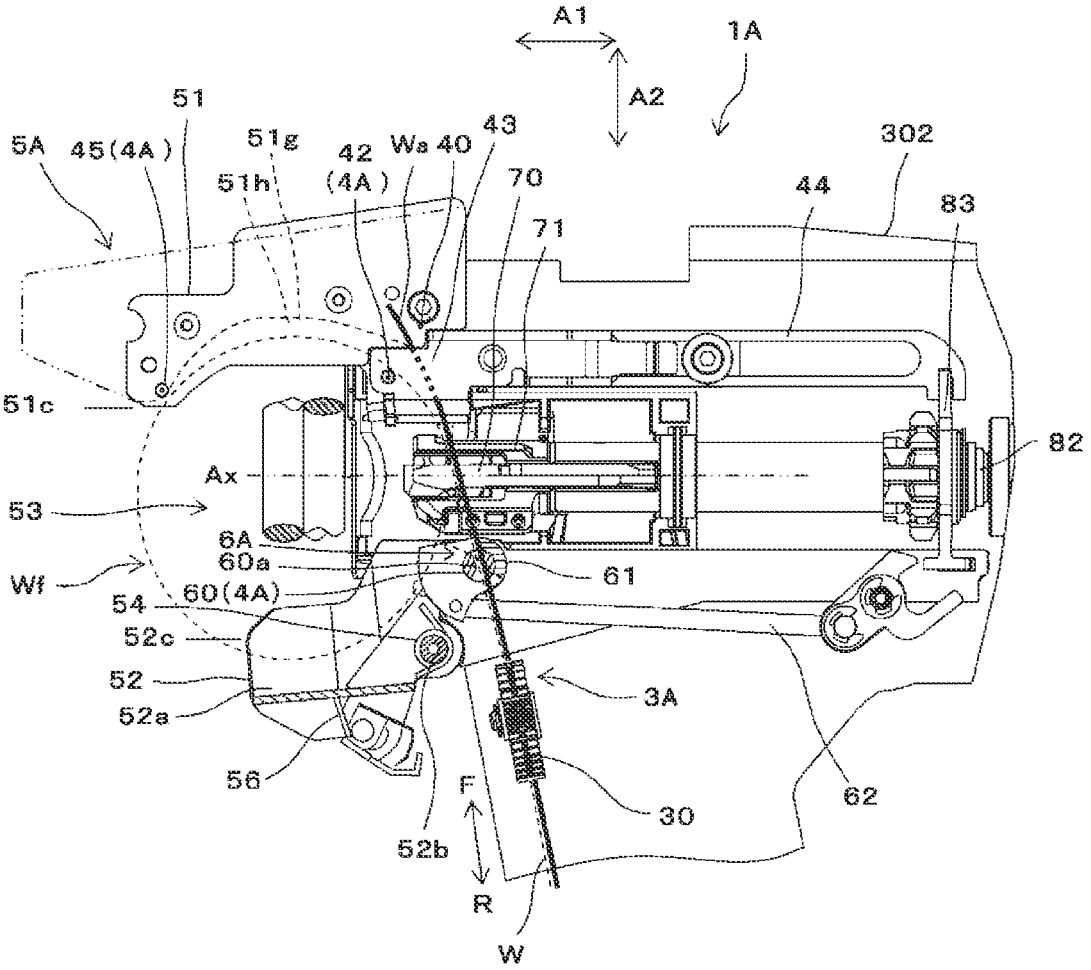
FIG. 4B is a side view showing the inside of the reinforced bar binding machine of the first embodiment.
Figure 4C:
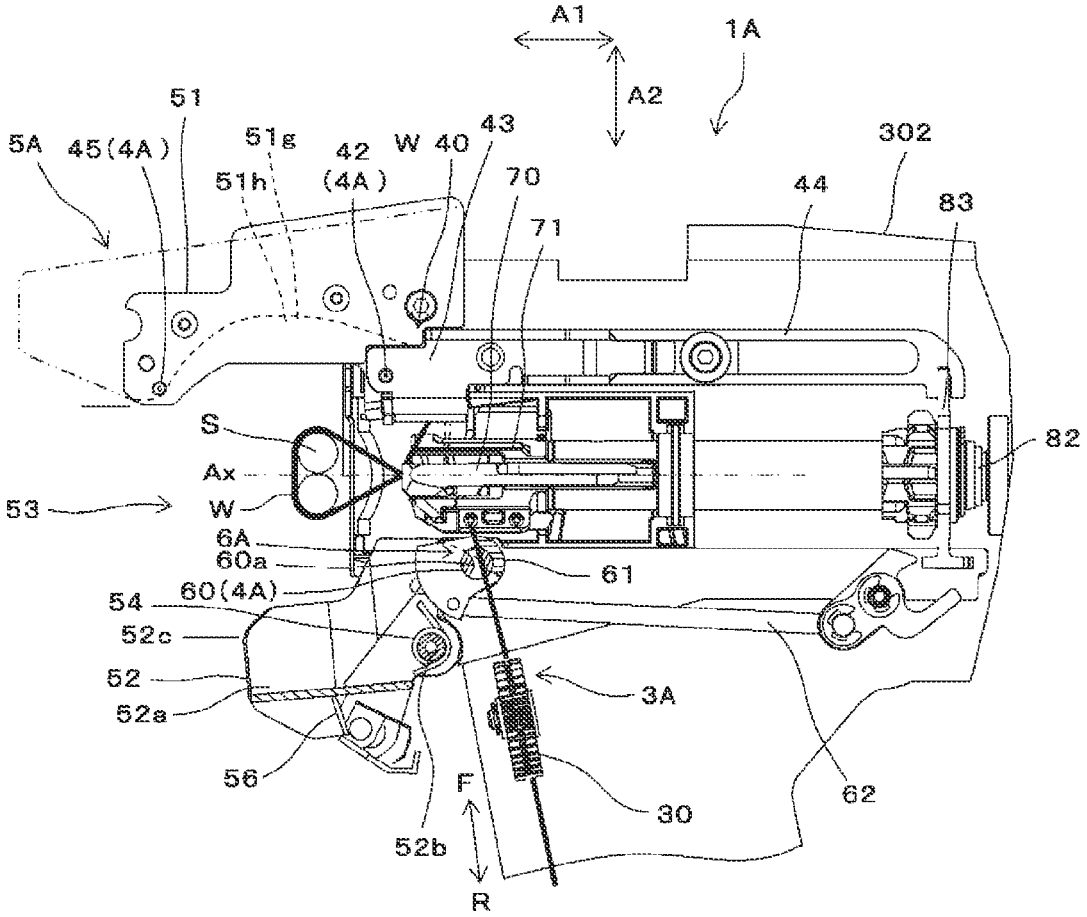
FIG. 4C is a side view showing the inside of the reinforced bar binding machine of the first embodiment.
Figure 5:
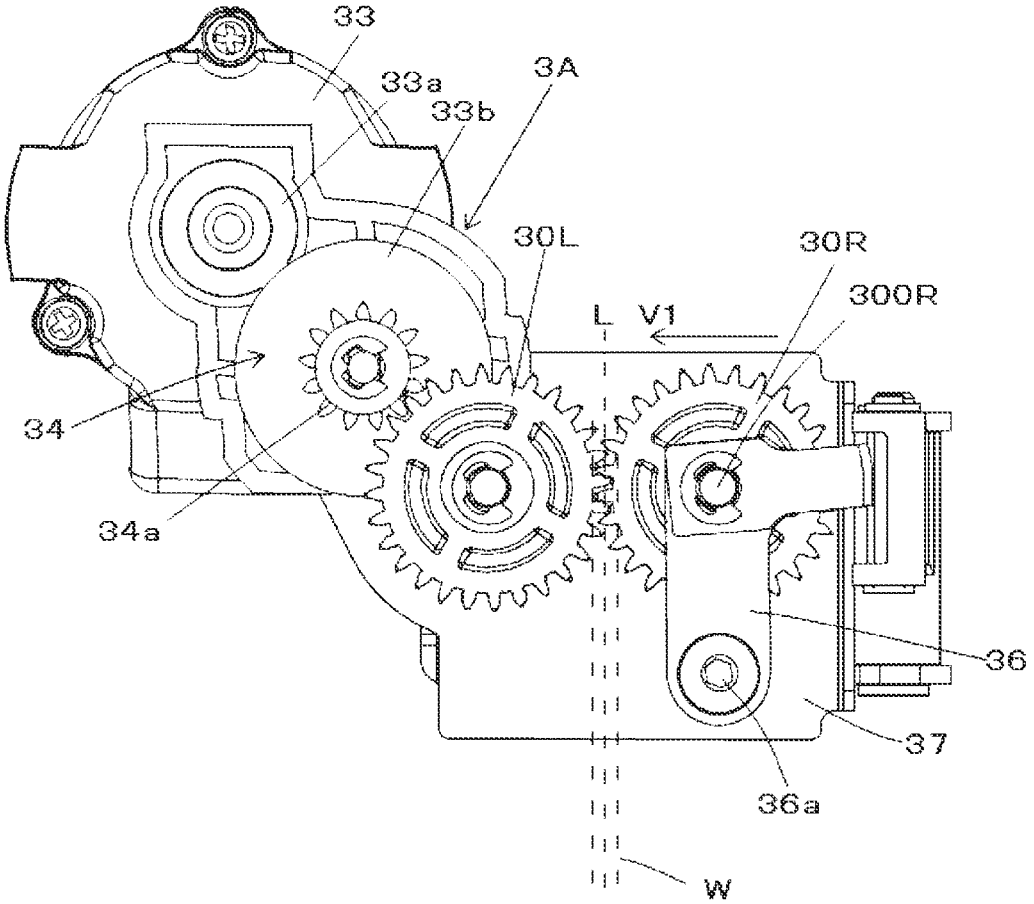
FIG. 5 shows a feeding unit of the reinforced bar binding machine of the first embodiment.
Figure 6A:
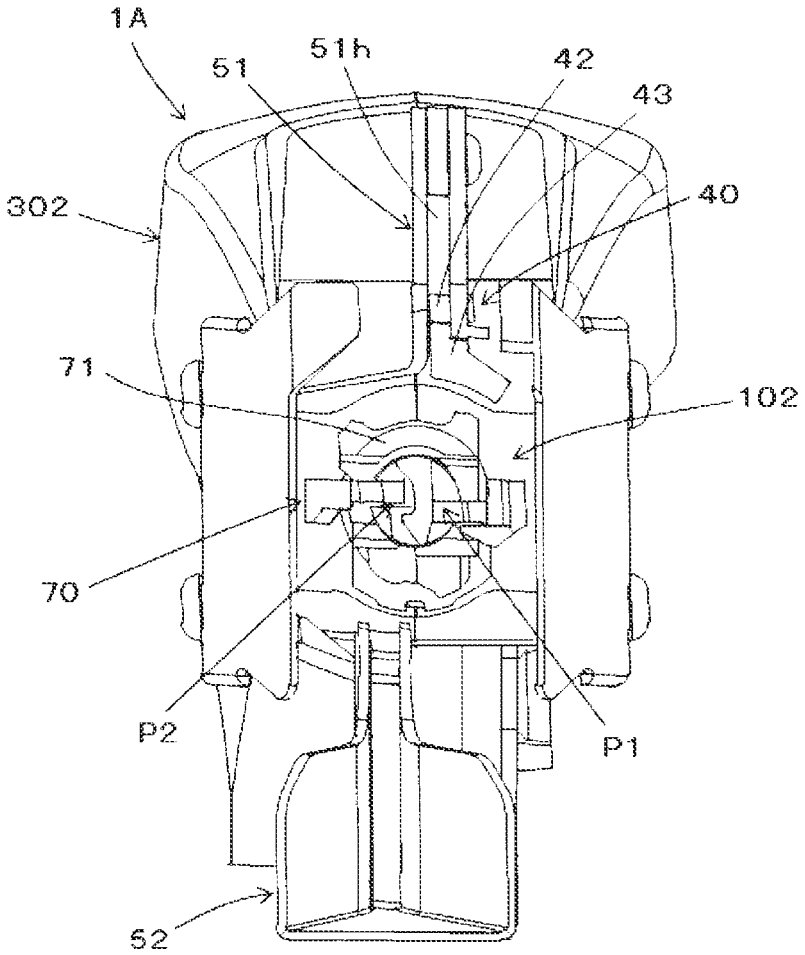
FIG. 6A shows a regulation part of the reinforced bar binding machine of the first embodiment.
Figure 6B:
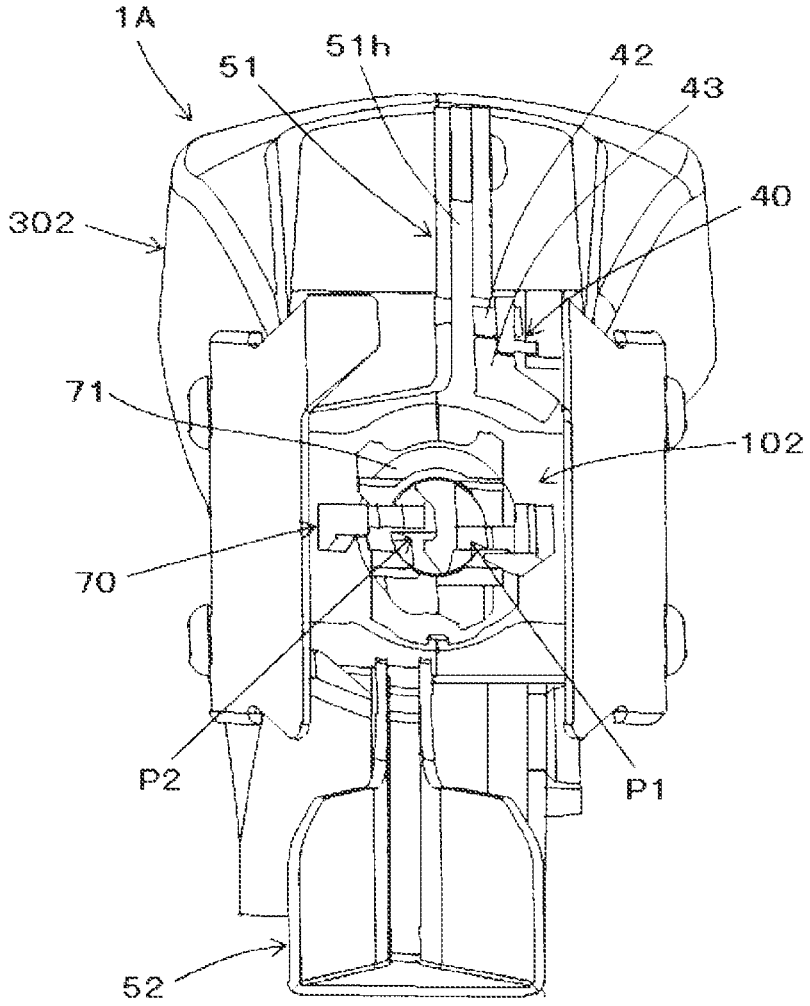
FIG. 6B shows the regulation part of the reinforced bar binding machine of the first embodiment.

FIGS. 1A to 1D are side views showing an example of an overall configuration of a reinforced bar binding machine 1A of a first embodiment, FIG. 1E is a top view showing the example of the overall configuration of the reinforced bar binding machine 1A of the first embodiment, FIG. 2A is a front view showing the example of the overall configuration of the reinforced bar binding machine 1A of the first embodiment, and FIG. 2B is a rear view showing the example of the overall configuration of the reinforced bar binding machine 1A of the first embodiment. FIG. 3 is a side view showing an example of an internal configuration of the reinforced bar binding machine 1A of the first embodiment, and FIGS. 4A to 4C are side views showing main parts of the internal configuration of the reinforced bar binding machine 1A of the first embodiment. FIG. 5 shows a feeding unit 3A of the reinforced bar binding machine 1A of the first embodiment. FIGS. 6A and 6B show a regulation part 4A of the reinforced bar binding machine 1A of the first embodiment.

As shown in FIGS. 1A to 1E and the like, the reinforced bar binding machine 1A of the first embodiment includes a first main body part 301 that can be held with a hand, a second main body part 302 having a mechanism for binding reinforced bars S with a wire NV, and an elongated connecting part 303 configured to connect the first main body part 301 and the second main body part 302.

The first main body part 301 has a pair of handle parts 304*h*L and 304*h*R that can be gripped by an operator. As shown in FIG. 2B, the first main body part 301 further has a power supply switch 16 by which a power supply of the reinforced bar binding machine 1A is turned on and off, and an operation unit 18 having a dial for adjusting a binding force, for example.

An exterior of the second main body part 302 is made of resin. As shown in FIGS. 3, 4A and the like, the second main body part 302 has an accommodation part 2A in which a wire reel 20 having a wire W wound thereon is rotatably accommodated, and a feeding unit 3A configured to feed the wire W wound on the wire reel 20 accommodated in the accommodation part 2A. The second main body part 302 also has a regulation part 4A configured to curl the wire W that is fed by the feeding unit 3A, and a guide part 5A configured to guide the wire W curled by the regulation part 4A. The second main body part 302 also has a cutting unit 6A configured to cut the wire W, a twisting unit 7A configured to twist the wire W, and a drive unit 8A configured to drive the cuffing unit 6A, the twisting unit 7A and the like.

As shown in FIG. 1A and the like, the reinforced bar binding machine 1A has the guide part 5A provided on one side of the second main body part 302. The reinforced bar binding machine 1A has such a configuration that the first main body part 301 and the second main body part 302 are connected by the connecting part 303. Therefore, as compared to a reinforced bar binding machine without the connecting part 303, a length between the guide part 5A and the handle parts 304*h*L and 304*h*R is further extended. In the present embodiment, a side on which the guide part 5A is defined as the front.

The accommodation part 2A is configured to detachably mount and support the wire reel 20. The feeding unit 3A has a pair of feeding gears 30 as a feeding member. The feeding unit 3A is configured such that a feeding motor 33 rotates the feeding gears 30 to feed the wire W in a state where the wire W is clamped between the pair of feeding gears 30. The feeding unit 3A can feed the wire W in a forward direction denoted with an arrow F and in a reverse direction denoted with an arrow R, according to a rotating direction of the feeding gears 30.

As shown in FIG. 5, the feeding unit 3A has a pair of first feeding gear 30L and second feeding gear 30R configured to feed the wire W with clamping the wire W by a rotation operation, and a displacement member 36 configured to displace the second feeding gear 30R toward and away from the first feeding gear 30L. The displacement member 36 has an end portion on one side on which the second feeding gear 30R is rotatably supported by a shaft 300R. The displacement member 36 has an end portion on the other side, which is rotatably supported about a shaft 36*a* as a support point by a support member 37 of the feeding unit 3A.

The displacement member 36 is pressed by a spring (not shown) and is configured to be displaced in a direction of an arrow V1 by a rotation operation about the shaft 36*a* as a support point. Thereby, the second feeding gear 30R is pressed toward the first feeding gear 30L by a force of the spring. As shown in FIG. 1A and the like, the second main body part 302 is provided with a release lever 39 for causing the second feeding gear 30R to move toward and away from the first feeding gear 30L via the displacement member 36.

The feeding unit 3A has a feeding motor 33 configured to drive one of the first feeding gear 30L and the second feeding gear 30R, in the present embodiment, the first feeding gear 30L, and a drive motor transmission mechanism 34 configured to transmit a drive force of the feeding motor 33 to the first feeding gear 30L.

The drive motor transmission mechanism 34 has a small gear 33*a* attached to a shaft of the feeding motor 33, and a large gear 33*b* in mesh with the small gear 33*a*. The drive motor transmission mechanism 34 also has a feeding small gear 34*a* in mesh with the first feeding gear 30L, to which the drive force is transmitted from the large gear 33*b*.

The first feeding gear 30L is configured to rotate as a rotation operation of the feeding motor 33 is transmitted thereto via the drive motor transmission mechanism 34. A rotation operation of the first feeding gear 30L is transmitted to the second feeding gear 30R, so that the second feeding gear 30R rotates according to the first feeding gear 30L.

The feeding unit 3A is configured to switch the rotating directions of the first feeding gear 30L and the second feeding gear 30R by switching the forward and reverse of the rotating direction of the feeding motor 33, thereby switching the forward and reverse of the feeding direction of the wire W.

As shown in FIG. 4A and the like, the cutting unit 6A is provided downstream of the feeding unit 3A with respect to feeding of the wire W in a forward direction denoted with an arrow F. The cutting unit 6A has a fixed blade part 60, and a movable blade part 61 configured to cut the wire W by cooperating with the fixed blade part 60. The cutting unit 6A also has a transmission mechanism 62 configured to transmit power from the drive unit 8A to the movable blade part 61.

The fixed blade part 60 has an opening 60*a* through which the wire W passes. The movable blade part 61 is configured to cut the wire W passing through the opening 60*a* of the fixed blade part 60 by a rotation operation about the fixed blade part 60 as a support point.

The regulation part 4A has first to third regulation members in contact with the wire W at a plurality of places, in the present example, at least three places along the feeding direction of the wire W that is fed by the feeding unit 3A, and is configured to curl the wire W along a feeding path Wf of the wire W shown with a broken line in FIG. 4B. The fixed blade pan 60 functions as the first regulation member to curl the wire W.

The regulation part 4A has a regulation member 42 as a second regulation member on a downstream side of the fixed blade part 60 with respect the feeding of the wire W in the forward direction denoted with the arrow F, and a regulation member 45 as a third regulation member on a downstream side of the regulation member 42. The regulation member 42 and the regulation member 45 are each constituted by a cylindrical member, and are in contact with the wire W on outer peripheral surfaces thereof.

As for the regulation part 4A, the fixed blade part 60, and the regulation member 42 and the regulation member 45 each constituted by a guide pin or the like are arranged on a curved line, in conformity to the feeding path Wf of the wire W that is substantially annular in a spiral shape. The opening 60*a* of the fixed blade part 60, through which the wire W passes, is provided on the feeding path Wf of the wire W. In addition, the regulation member 42 is provided on a radially inner side with respect to the feeding path Wf of the wire W. The regulation member 45 is provided on a radially outer side with respect to the feeding path Wf of the wire W.

Thereby, the wire W that is fed by the feeding unit 3A passes in contact with the fixed blade part 60, the regulation member 42 and the regulation member 45, so that the wire W is curled to follow the feeding path Wf of the wire W.

As shown in FIG. 6A and the like, the second main body part 302 is provided with a space 102 through which the wire W passes by an operation of binding the reinforced bars S with the wire W and in which a gripping part 70 of the twisting unit 7A, an actuation unit 71, a function unit 40 positioned on a feeding locus of the wire W, and the like operate.

As shown in FIG. 4A and the like, the function unit 40 has the regulation member 42 that constitutes the regulation part 4A, and a retreat mechanism 43 to which the regulation member 42 is attached. The retreat mechanism 43 is connected to a transmission member 44 configured to operate in conjunction with a moving member 83 of the drive unit 8A, and is configured so that a position can vary with respect to the feeding locus of the wire W. Specifically, the regulation member 42 and the retreat mechanism 43 are located in a first position on the feeding locus of the wire W, in which they are in contact with the wire W, during operations of feeding the wire W in the forward direction by the feeding unit 3A and curling the wire W, as shown in FIG. 6A. In addition, the regulation member 42 and the retreat mechanism 43 are moved to a second position deviating from the feeding locus of the wire W, in which they are not in contact with the wire W, as shown in FIG. 6B, before operations of feeding the wire W shown in FIG. 4C in the reverse direction and winding the wire W on the reinforced bars S.

As shown in FIG. 4A and the like, the guide part 5A has a first guide 51 configured to guide the wire W, and a second guide 52 configured to guide the wire W curled by the regulation part 4A and the first guide 51 toward the twisting unit 7A.

The first guide 51 is attached to an end portion on a front side of the second main body part 302, and extends in a first direction that is a front and rear direction denoted with an arrow A1. The first guide 51 has a groove portion 51*h* having a guide surface 51*g* with which the wire W that is fed by the feeding unit 3A is in sliding contact.

When a side of the first guide 51, which is attached to the second main body part 302, is referred to as a base end-side and a side extending in the first direction from the second main body part 302 is referred to as a tip end-side, the base end-side is attached to the second main body part 302 by a screw or the like.

The first guide 51 is provided on the base end-side with the regulation member 42 and on the tip end-side with the regulation member 45. The first guide 51 has a gap through Which the wire W can pass between the guide surface 51*g* and the outer peripheral surface of the regulation member 42. In the first guide 51, a part of the outer peripheral surface of the regulation member 45 protrudes toward the guide surface 51*g*.

As shown in FIGS. 1A, 4A and the like, the second guide 52 is attached to an end portion on the front side of the second main body part 302. The second guide 52 is provided to face the first guide 51 in a second direction denoted with an arrow A2, which is a vertical direction orthogonal to the first direction. The first guide 51 and the second guide 52 are spaced by a predetermined interval in the second direction, and an insertion/removal opening 53 through which the reinforced bars S are inserted/removed is formed between the first guide 51 and the second guide 52.

The second guide 52 is configured to move between a first position in which a distance between an end portion 52*c* on the tip end-side of the second guide 52 and an end portion 51*c* of the first guide 51 is a first distance (refer to FIG. 4A) and a second position in which the distance between the end portion 52*c* of the second guide 52 and the end portion 51*c* of the first guide 51 is a second distance shorter than the first distance (refer to FIG. 4B) by rotation about a shaft 52*b* as a support point, in conjunction with a pair of contact members (which will be described later).

In a state of being located in the second position, the second guide 52 is in a state where the end portion 52*c* of the second guide 52 and the end portion 51*c* of the first guide 51 are opened therebetween. In a state of being located in the first position, the interval between the end portion 52*c* of the second guide 52 and the end portion 51*c* of the first guide 51 is widened, so that the reinforced bars can be more easily inserted into the insertion/removal opening 53 between the first guide 51 and the second guide 52.

The second guide 52 is urged by an urging member 54 constituted by a tortional coil spring or the like in a direction of moving toward the first position, and is kept in the first position.

The second guide 52 has a receiving part 56 configured to receive an operation of a pair of contact members (which will be described later) via a link part. The receiving part 56 is constituted by a surface perpendicular to a lower surface of the second guide 52 or a surface inclined relative to the lower surface of the second guide 52 with respect to the vertical direction.

As shown in FIGS. 1A to 1D, the reinforced bar binding machine 1A includes a first contact member 9AL and a second contact member 9AR against which the reinforced bars S inserted in the insertion/removal opening 53 between the first guide 51 and the second guide 52 are butted. The first contact member 9AL is configured to operate in conjunction with a butting operation against the reinforced bars S, thereby turning on a first sensor 12L (which will be described later). The second contact member 9AR is configured to operate in conjunction with a butting operation against the reinforced bars S, thereby turning on a second sensor 12R (which will be described later).

The reinforced bar binding machine 1A further includes a first link member 96L configured to transmit an operation of the first contact member 9AL to the second guide 52, and a second link member 96R configured to transmit an operation of the second contact member 9AR to the second guide 52. The first link member 96L and the second link member 96R are rotatably supported by a shaft 96A. When the first contact member 9AL, and the second contact member 9AR are butted against the reinforced bars S by an operator, the first link member 96L and the second link member 96R are rotated about the shaft 96A as a support point, so that the second guide 52 is moved from the first position to the second position.

As shown in FIGS. 3, 4A and the like, the twisting unit 7A has a gripping part 70 to which the wire W is engaged, and an actuation unit 71 configured to actuate the gripping part 70. The gripping part 70 is formed with a first passage P1 through which the wire W fed to the cutting unit 6A by the feeding unit 3A passes, and a second passage P2 through which the wire W curled by the regulation part 4A and guided to the twisting unit 7A by the guide part 5A passes. The gripping part 70 is configured to rotate by an operation of the actuation unit 71, thereby twisting the wire W wound on the reinforced bars S.

As shown in FIGS. 3, 4A and the like, the drive unit 8A has a twisting motor 80 configured to drive the twisting unit 7A and the like, a decelerator 81 configured to perform deceleration and amplification of torque, a rotary shaft 82 configured to drive and rotate via the decelerator 81 by the twisting motor 80, and a moving member 83 configured to transmit a drive force to the cutting unit 6A and the regulation member 42. In the twisting unit 7A and the drive unit 8A, the rotary shaft 82 and rotation centers of the actuation unit 71 and gripping part 70*a* are arranged coaxially. The rotary shaft 82 and the rotation centers of the actuation unit 71 and gripping part 70 are referred to as an axis line Ax. In the present embodiment, the first direction denoted with the arrow A1 is a direction along the axis line Ax.

The drive unit 8A is configured to move the actuation unit 71 along an axis direction of the rotary shaft 82 by a rotation operation of the rotary shaft 82. The actuation unit 71 is moved along the axis direction of the rotary shaft 82, so that the gripping part 70 holds the tip end-side of the wire W guided to the twisting unit 7A by the guide part 5A.

In the drive unit 8A, the moving member 83 is moved along the axis direction of the rotary shaft 82, in conjunction with movement of the actuation unit 71 along the axis direction of the rotary shaft 82. The operation of the moving member 83 is transmitted to the retreat mechanism 43 via the transmission member 44, so that the regulation member 42 and the retreat mechanism 43 are moved from the first position in which they are in contact with the wire to the second position in which they are not in contact with the wire. Thereafter, the wire W is pulled back in the reverse direction by reverse rotation of the feeding motor 33, so that the wire W is closely contacted to the reinforced bars S. In addition, the actuation unit 71 is moved along the axis direction of the rotary shaft 82, so that movement of the moving member 83 is transmitted to the movable blade part 61 by the transmission mechanism 62 and the movable blade part 61 is actuated to cut the wire W.

The drive unit 8A is configured to rotate the actuation unit 71 moved along the axis direction of the rotary shaft 82 by the rotation operation of the rotary shall 82. The actuation unit 71 is configured to rotate around the axis of the rotary shaft 82, thereby twisting the wire W by the gripping part 70.

(Example of Hardware Configuration of Reinforced Bar Binding Machine 1A)

Figure 7:
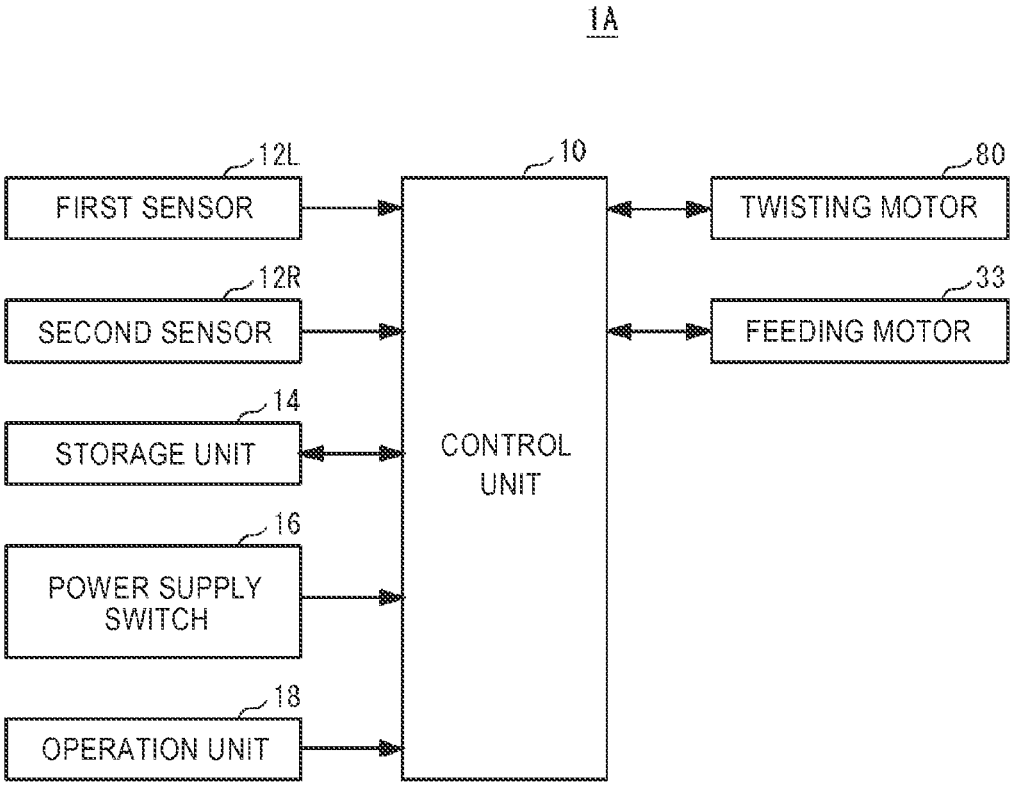
FIG. 7 is a block diagram showing a hardware configuration of the reinforced bar binding machine of the first embodiment.

FIG. 7 is a block diagram showing an example of a hardware configuration of the reinforced bar binding machine 1A. As shown in FIG. 7, the reinforced bar binding machine 1A includes a control unit 10, a first sensor 12L, a second sensor 12R, a storage unit 14, a power supply switch 16, the operation unit 18, the twisting motor 80, and the feeding motor 33.

The control unit 10 includes a CPU (Central Processing Unit) functioning as an arithmetic processing unit, and is configured to control overall operations of the reinforced bar binding machine 1A according to diverse programs stored in the storage unit 14 and the like.

The first sensor 12L and the second sensor 12R are constituted by magnetic sensors, for example, and are configured to output an on-signal to the control unit 10 by detecting a detection portion (not shown) whose position is displaced by the butting operation of the first contact member 9AL and the second contact member 9AR against the reinforced bars S.

The storage unit 14 includes a ROM (Read Only Memory), a RAM (Random Access Memory), a semiconductor memory device, a hard disk, an optical disk or the like. In the storage unit 14, programs, arithmetic parameters, a variety of data and the like that are used by the control unit 10 when performing the binding operation are stored.

The power supply switch 16 is configured to output, to the control unit 10, an on-signal based on turning on of the power supply and an off-signal based on turning off of the power supply as a result of an operator's operation. The operation unit 18 is configured to output, to the control unit 10, a binding force signal based on a level of the binding force adjusted in a dial manner by the operator.

The control unit 10 is configured to output a drive signal for feeding the wire W in the forward direction or the reverse direction to the feeding motor 33 via, a drive circuit (not shown), based on the on-signals supplied from the first sensor 12L and the second sensor 12R. The feeding motor 33 are configured to drive based on the drive signal supplied from the control unit 10, thereby rotating the first feeding gear 30L and the second feeding gear 30R in the forward direction or the reverse direction.

The control unit 10 is configured to output a drive signal for advancing or retreating the actuation unit 71 to the twisting motor 80 via the drive circuit (not shown), based on the on-signals supplied from the first sensor 12L and the second sensor 12R. The twisting motor 80 is configured to drive based on the drive signal supplied from the control unit 10, thereby advancing or retreating the actuation unit 71.

(Problems in Case where Function Unit 40 is Regulation Member 42 of Regulation Part 4A and Retreat Mechanism 43)

Here, in a case where the reinforced bars are bound using a reinforced bar binding machine of the related art, problems that occur in the retreat mechanism 43, which is one of the function unit 40, are described. Note that, since a configuration of the reinforced bar binding machine of the related art and the configuration of the reinforced bar binding machine 1A of the present embodiment have common parts, for convenience, the descriptions are made using the reinforced bar binding machine 1A shown in FIG. 1A and the like.

When the binding operation starts, the actuation unit 71 is advanced by drive of the twisting motor 80, the wire W is accordingly gripped by the gripping part 70, and the regulation member 42 and the retreat mechanism 43 are then retreated from the first position to the second position. Subsequently, the wire W is pulled back to wind the wire W around the reinforced bars S, the wire W is cut, and the actuation unit 71 is then rotated around the rotary shaft 82, so that a twisting operation of the wire W is executed. Note that, the twisting unit 7A is urged rearward by a compression spring arranged in the rotary shaft 82, and can be slightly advanced and retreated by expansion and contraction of the compression spring.

While twisting the wire W, the wire W is wound and tightened, so that a loop diameter of the wire W is reduced (a twisting margin is shortened), so that the gripping part 70 and the actuation unit 71 are pulled forward. Accordingly, the compression spring is compressed, and the gripping part 70 and the actuation unit 71 are stopped in positions advanced toward the reinforced bars S.

In the meantime, after the reinforced bars S are bound with the wire W, the gripping part 70 releases the wire W and the gripping part 70 and the actuation unit 71 are returned to initial positions as the actuation unit 71 is retreated, in a normal case. However, if the binding operation is not normally over (if abnormality occurs), the gripping part 70 releases the wire W as the actuation unit 71 is retreated, but a portion of the wire W after the binding may be caught at the gripping part 70.

In this case, the actuation unit 71 is retreated with respect to the gripping part 70 as the twisting motor 80 is driven in the reverse rotation but the positions of the gripping part 70 and the actuation unit 71 are held in further forward positions than the initial positions due to the compression of the spring. Since the regulation member 42 and the retreat mechanism 43 depend on the positions of the gripping part 70 and the actuation unit 71, they are kept in the second position.

In this state, while the operator performs an operation of releasing the caught state of the wire W, the first contact member 9AL and the second contact member 9AR may be unintentionally butted against the reinforced bars S. In this case, the binding operation is started, so that the wire W is fed forward by drive of the feeding motor 33. At this time, as shown in FIG. 4B, the wire W (Wa) shown with the thick line deviates from the conveying path and is inserted into a gap between the retreat mechanism 43 and the first guide 51, depending on a feeding posture of the wire W and the like, in some cases.

At this timing, when the caught state of the wire W after the binding and the gripping part 70 is released, the compression spring is expanded, so that the gripping part 70 and the actuation unit 71 are retreated and returned to the initial positions. Accordingly, the regulation member 42 and the retreat mechanism 43, which depend on the position of the actuation unit 71, are moved from the second position to the first position. Thereby, since the gap between the first guide 51 and the retreat mechanism 43 is blocked, the wire W is caught between the first guide 51 and the retreat mechanism 43, so that the operator cannot easily remove the wire W from the first guide 51 and the like.

Figure 8:
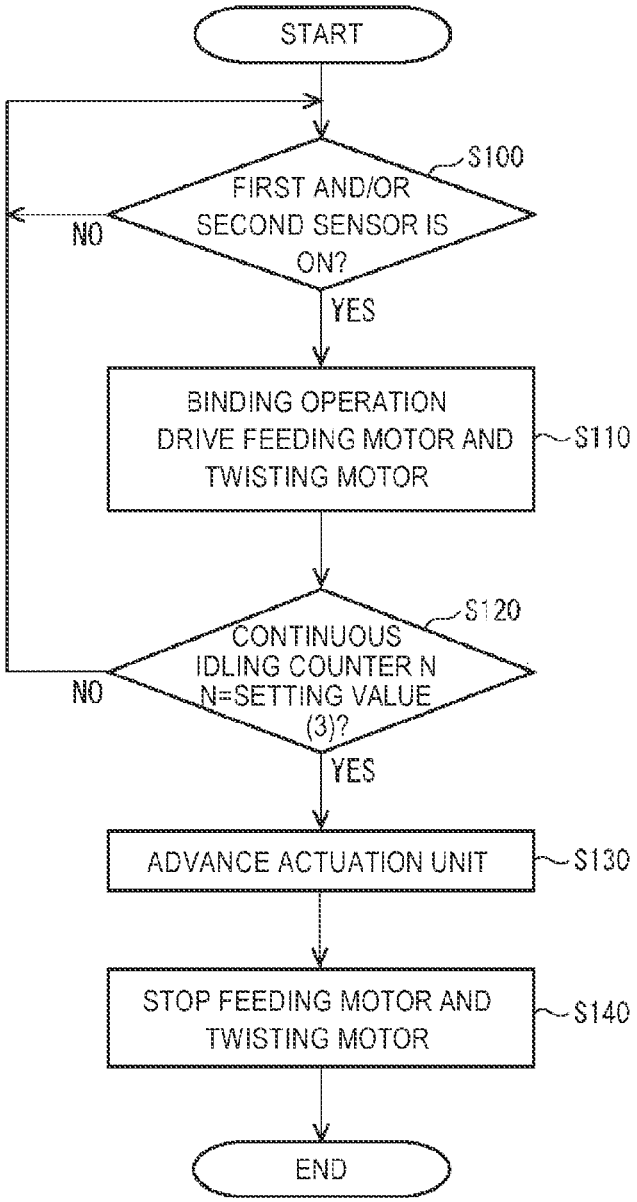
FIG. 8 is a flowchart showing an example of an operation of the reinforced bar binding machine of the first embodiment.

Therefore, in the present embodiment, control shown in FIG. 8 is executed to enable easy removal of the wire W from the first guide 51 and the like.

(Example of Control of Reinforced Bar Binding Machine 1A)

FIG. 8 is a flowchart showing an example of control of the reinforced bar binding machine 1A that is executed when the wire W is caught between the first guide 51 and the retreat mechanism 43.

First, when the operator confirms that the wire W is caught between the first guide 51 and the retreat mechanism 43, the operator operates the release lever 39. Thereby, the second feeding gear 30R is spaced from the first feeding gear 30L, so that the engagement between the first feeding gear 30L and the second feeding gear 30R is released.

Subsequently, as shown in FIG. 8, in step S100, the operator executes an on-operation of the first contact member 9AL and the second contact member 9AR. Note that, the on-operation of the first contact member 9AL and the second contact member 9AR includes causing the first contact member 9AL and the like to butt against the reinforced bars S. It is not necessarily required to perform the on-operation of both the first contact member 9AL and the second contact member 9AR, and it is sufficient to perform the on-operation of at least one of the contact members. The control unit 10 determines whether an on-signal based on the on-operation of the first contact member 9AL and the second contact member 9AR is supplied from at least one of the first sensor 12L and the second sensor 12R.

In step S110, when it is determined that an on-signal is supplied from at least one of the first sensor 12L and the second sensor 12R, the control unit 10 starts the binding operation. Specifically, the control unit 10 drives the feeding motor 33 and the twisting motor 80. At this time, since the engagement between the first feeding gear 30L and the second feeding gear 30R has been released, the wire W is in an idle feeding state, a load current of the feeding motor 33 does not increase and an idle binding operation is executed. For this reason, the control unit 10 determines that the wire W is not being normally feed, from an output result of the load current of the feeding motor 33, increments a continuous idling counter N (N=1), and stores a result thereof in the storage unit 14. When a series of idle binding operations are over, the control unit 10 stops the feeding motor 33 and the twisting motor 80. The actuation unit 71 and the like return to the initial positions.

In the present embodiment, the idle binding operation is executed three times by the operator, for example. Note that, the number of times of the idle binding operation is not limited to three times, and may be one or more times. The idle binding operation is executed more than one time, so that it is possible to correctly determine that the idle feeding of the wire W has occurred. Note that, a sensor configured to detect whether or not the operation of the release lever 39 may be provided, and when the operation of the release lever 39 is detected by the sensor, it is possible to check in advance that the idle feeding of the wire W is to occur. Therefore, the idle binding operation may be set to one time.

In step S120, the control unit 10 determines whether the idle binding operation has been consecutively executed three times and the continuous idling counter N becomes 3 (N=3). When it is determined that the continuous idling counter N is not 3 (N≠3), the control unit 10 returns to step S100, and executes the idle binding operation of steps S100 and S110.

On the other hand, when it is determined that the continuous idling counter N is 3 (N=3), the control unit 10 proceeds to step S130. In step S130, the control unit 10 drives the feeding motor 33 to rotate the first feeding gear 30L, and drives the twisting motor 80 to advance the actuation unit 71. As the actuation unit 71 is advanced, the regulation member 42 and the retreat mechanism 43 are moved from the first position to the second position.

In step S140, the control unit 10 stops the twisting motor 80 and the feeding motor 33 in the position to which the actuation unit 71 is advanced, thereby stopping the idle binding operation. Thereby, the regulation member 42 and the retreat mechanism 43 are stopped in the second position and the retreat mechanism 43 is spaced from the first guide 51, so that a gap is formed between the first guide 51 and the retreat mechanism 43.

Since the gap is formed between the first guide 51 and the retreat mechanism 43, the operator can easily remove the wire W caught at the first guide 51 or the like. When the operation of removing the wire W is over, the power supply switch 16 is turned off by the operator. When the power supply switch 16 is again turned on, the control unit 10 executes initialization of returning the actuation unit 71 and the like to the initial positions and then executes the binding operation when the first contact member 9AL and the like become on. Note that, the resumption of the binding operation is also implemented by control other than the turning on/off of the power supply switch 16.

(In Case where Function Unit 40 is Gripping Part 70)

The gripping part 70 includes hooks that are opened and closed in conjunction with the operation of the actuation unit 71, and is configured to be movable between a first position in which the hooks are opened and a second position in which the hooks are closed. Note that, the second position includes not only a completely closed state but also a slightly further closed state than the first position.

Here, when feeding the wire W in the forward direction and winding the wire W around the reinforced bars 5, the wire W passes through a first passage P1 and a second passage P2 shown in FIG. 6A and the like between the hooks of the gripping part 70 located in the first position. However, depending on a feeding posture of the wire W and the like, the wire W may collide with the hooks, so that deviation of the wire W from the conveying path, clogging of the wire W and jam due to buckling of the wire W and the like may occur.

In this case, the control unit 10 can move the hooks of the gripping part 70 from the first position to the second position by performing control of advancing and retreating the actuation unit 71. It is possible to determine whether poor feeding of the wire W has occurred, according to variation in load current of the feeding motor 33, for example. Thereby, it is possible to release entanglement of the wire W, thereby resolving the jam. In addition, a predetermined rotation angle of the gripping part 70 may be set to the first position, a rotation angle rotated by a predetermined angle from the first position around the rotary shaft 82 may be set to the second position, and when poor feeding of the wire W occurs, the gripping part 70 may be rotated from the first position to the second position.

As described above, according to the first embodiment, for example, even when the poor feeding of the wire W occurs on the function unit 40 including the retreat mechanism 43, the retreat mechanism 43 can be set to the predetermined state, for example, the second position by executing the control shown in FIG. 8, for example. Thereby, since the gap is formed between the retreat mechanism 43 and the first guide 51, the wire W can be easily removed from the gap between the retreat mechanism 43 and the first guide 51, so that the jam of the wire W can be solved.

Further, according to the first embodiment, for example, when the poor feeding of the wire W occurs on the gripping part 70, the gripping part 70 can be set to the second position, so that the wire W can be easily removed from the gripping part 70 and the like.

First Modified Embodiment

Subsequently, a first modified embodiment where the function unit 40 is set to the second position by a means different from the control shown in FIG. 8 is described. In the below; a case where the function unit 40 is the regulation part 4A is described.

Figure 9:
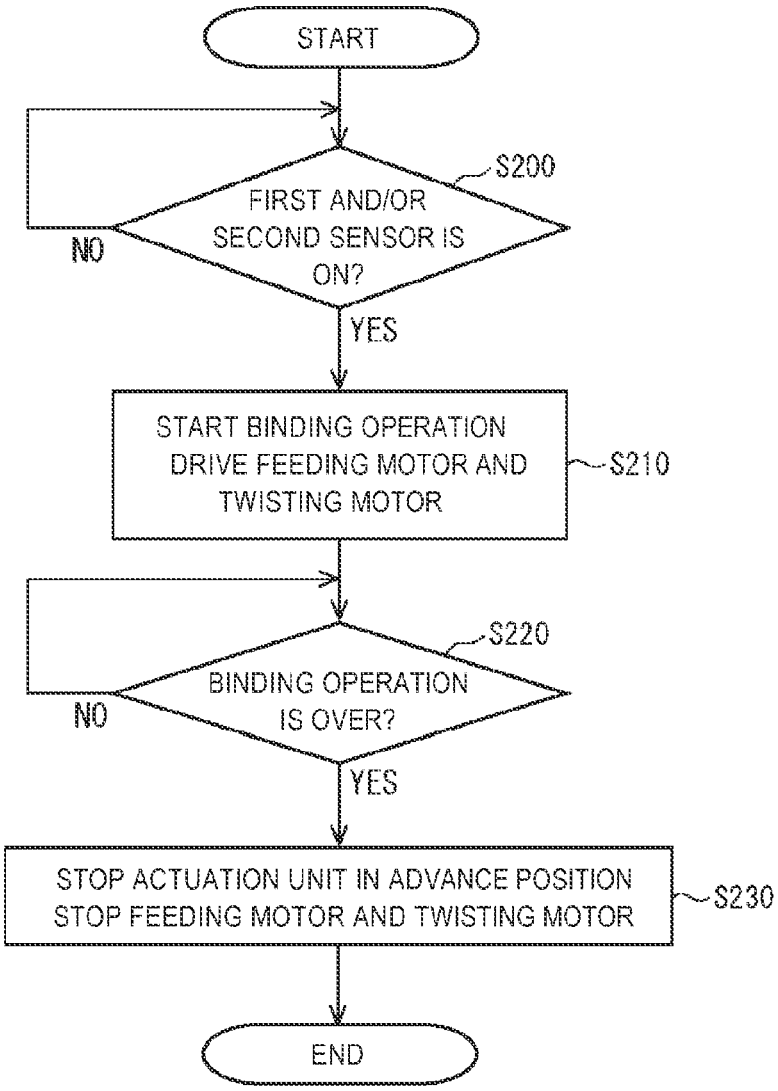
FIG. 9 is a flowchart showing an example of an operation of a reinforced bar binding machine of a first modified embodiment.

FIG. 9 is a flowchart showing an example of control of the reinforced bar binding machine 1A that is executed when the wire W is caught between the first guide 51 and the retreat mechanism 43. Note that, the detailed descriptions of the processing that is the same as or similar to the control described in FIG. 8 are omitted.

As shown in FIG. 9, in step S200, the control unit 10 determines whether an on-signal is supplied from the first sensor 12L and the like by an on-operation of the first contact member 9AL and the like. When the on-signal is supplied, the control unit 10 proceeds to step S210.

In step S210, the control unit 10 drives the feeding motor 33 and the twisting motor 80 to start the binding operation. Thereby, the feeding of the wire W by the feeding unit 3A, and the gripping and twisting on the wire W by the twisting unit 7A are performed to bind the reinforced bars S with the wire W.

In step S220, the control unit 10 determines whether the binding operation is over. When it is determined that the binding operation is over, the control unit 10 proceeds to step S230. At this time, it is assumed that the gripping and twisting operations on the wire W are over and the actuation unit 71 is located in a position advanced toward the reinforced bars S.

In step S230, the control unit 10 executes a first mode of driving the twisting motor 80 in the reverse rotation direction to retreat and stop the actuation unit 71 in a position in which the gripping part 70 releases the wire W, thereby stopping the actuation unit 71 in a position (advance position) further advanced than the initial position. Thereby, the regulation member 42 and the retreat mechanism 43 configured to operate in conjunction with the actuation unit 71 can be stopped in the second position spaced from the first guide 51. In addition, after the binding operation is over, the actuation unit 71 may be retreated and returned to the initial position, and the actuation unit 71 may be then advanced to stop in the advance position.

Note that, the first mode may be set as a default setting, and a second mode of moving the retreat mechanism 43 to the first position after the binding is over may also be selected. The first mode and the second mode may be manually switched by the operator, or may be automatically switched according to occurrence of the poor feeding of the wire W, for example.

According to the first modified embodiment, for example, after the reinforced bars S are bound by the wire W, even when a piece of the wire W is inserted between the retreat mechanism 43 and the first guide 51 located in the second position, the piece of the wire W is not caught between the retreat mechanism 43 and the first guide 51 and can be easily pulled out because the retreat mechanism 43 is stopped in the second position after the binding. Thereby, the jam can be prevented in advance.

Second Modified Embodiment

Subsequently, a second modified embodiment where the function unit 40 is set to the second position by a means different from the control shown in FIG. 8 is described. In the below, a case where the function unit 40 is the regulation part 4A is described.

(Example of Hardware Configuration of Reinforced Bar Binding Machine 1Aa)

Figure 10:
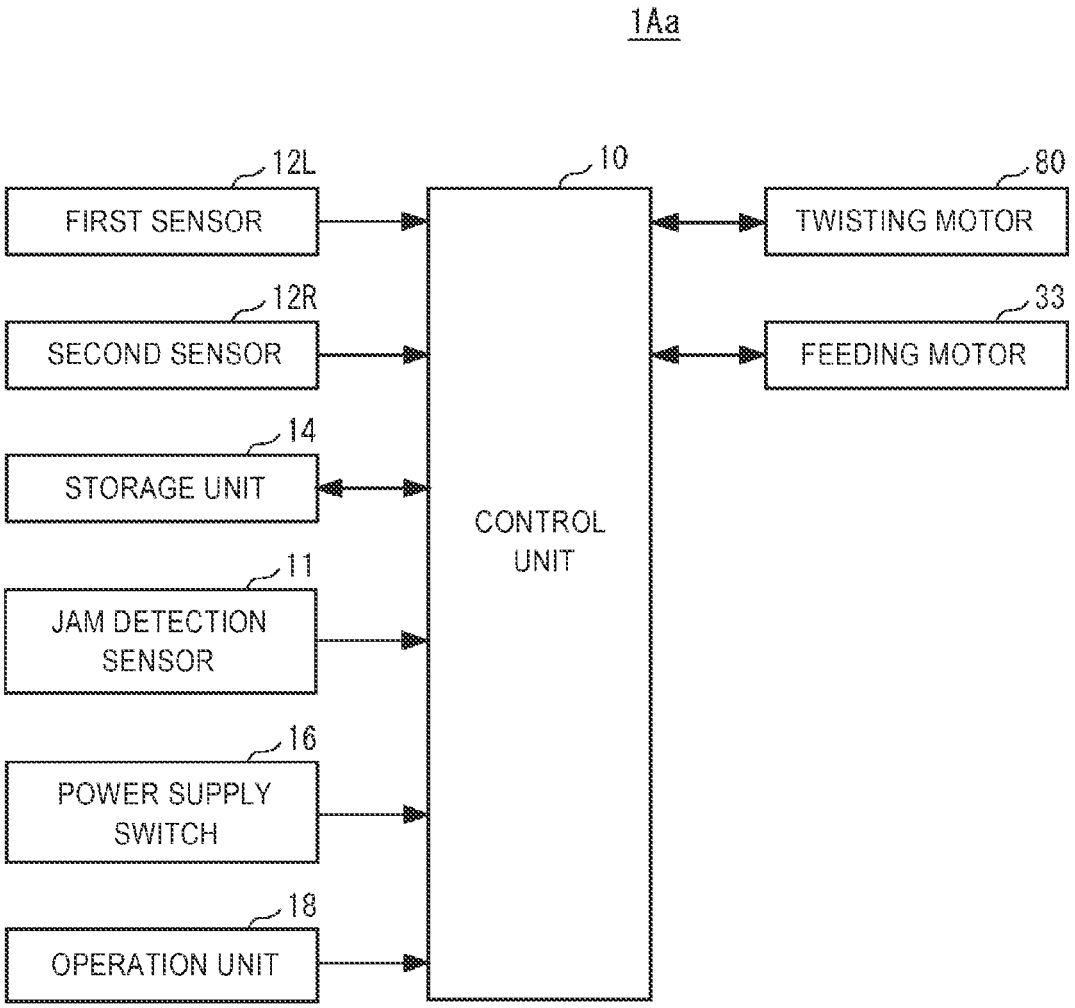
FIG. 10 is a block diagram showing a hardware configuration of a reinforced bar binding machine of a second modified embodiment.

FIG. 10 is a flowchart showing an example of a hardware configuration of a reinforced bar binding machine 1Aa. Note that, the constitutional elements having substantially the same functional configurations as the reinforced bar binding machine 1A of the first embodiment are denoted with the same reference signs, and the overlapping descriptions are omitted.

As shown in FIG. 10, the reinforced bar binding machine 1Aa includes the control unit 10, the first sensor 12L, the second sensor 12R, the storage unit 14, a jam detection sensor 11, the power supply switch 16, the operation unit 18, the twisting motor 80, and the feeding motor 33.

The jam detection sensor 11 is provided on the conveying path of the wire W, and is constituted by a reflection or transmission type optical sensor or the like, for example. The control unit 10 is configured to determine whether jam has occurred on the conveying path of the wire W, based on state information of the wire W supplied from the jam detection sensor 11. The jam detection sensor 11 may also be configured to detect whether jam has occurred, based on variation in current value of the feeding motor 33 and the twisting motor 80.

Figure 11:
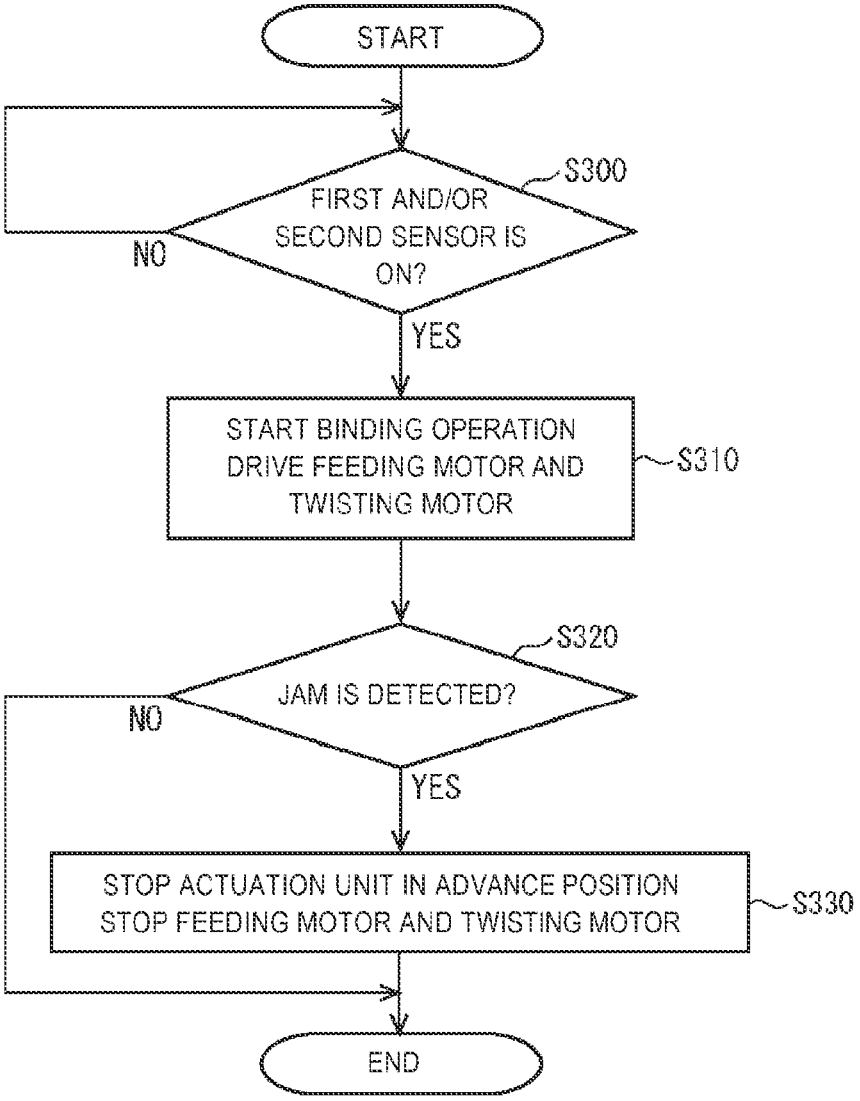
FIG. 11 is a flowchart showing an example of an operation of the reinforced bar binding machine of the second modified embodiment.

FIG. 11 is a flowchart showing an example of control of the reinforced bar binding machine 1Aa that is executed when the wire W is caught between the first guide 51 and the retreat mechanism 43. Note that, the detailed descriptions of the processing that is the same as or similar to the control described in FIG. 8 are omitted.

As shown in FIG. 11, in step S300, the control unit 10 determines whether an on-signal is supplied from the first sensor 12L and the like by an on-operation of the first contact member 9AL and the like. When the on-signal is supplied, the control unit 10 proceeds to step S310.

In step S310, the control unit 10 starts the binding operation. Thereby, the feeding of the wire W by the feeding unit 3A, and the gripping and twisting on the wire W by the twisting unit 7A are performed to bind the reinforced bars S with the wire W.

In step S320, the control unit 10 determines whether jam has occurred on the conveying path of the wire W, based on state information of the wire W supplied from the jam detection sensor 11. When it is determined that jam has occurred, the control unit 10 proceeds to step S330.

In step S330, the control unit 10 executes the first mode of stopping the actuation unit 71 in the advance position. Thereby, the regulation member 42 and the retreat mechanism 43 configured to operate in conjunction with the actuation unit 71 are stopped in the second position spaced from the first guide 51.

According to the second modified embodiment, for example, even when jam occurs on the first guide 51 and the retreat mechanism 43 during the binding operation, the jam detection sensor 11 detects the jam, so that the retreat mechanism 43 can be moved to the second position. As a result, the wire W caught between the retreat mechanism 43 and the first guide 51 can be easily pulled out to solve the jam. Note that, the control of the second modified embodiment can also be applied to a case where the jam occurs on the gripping part 70 that is an example of the function unit 40.

Third Modified Embodiment

Subsequently, a third modified embodiment where the function unit 40 is set to the second position by a means different from the control shown in FIG. 8 is described. In the below, a case where the function unit 40 is the regulation part 4A is described.

(Example of Hardware Configuration of Reinforced Bar Binding Machine 1Ab)

Figure 12:
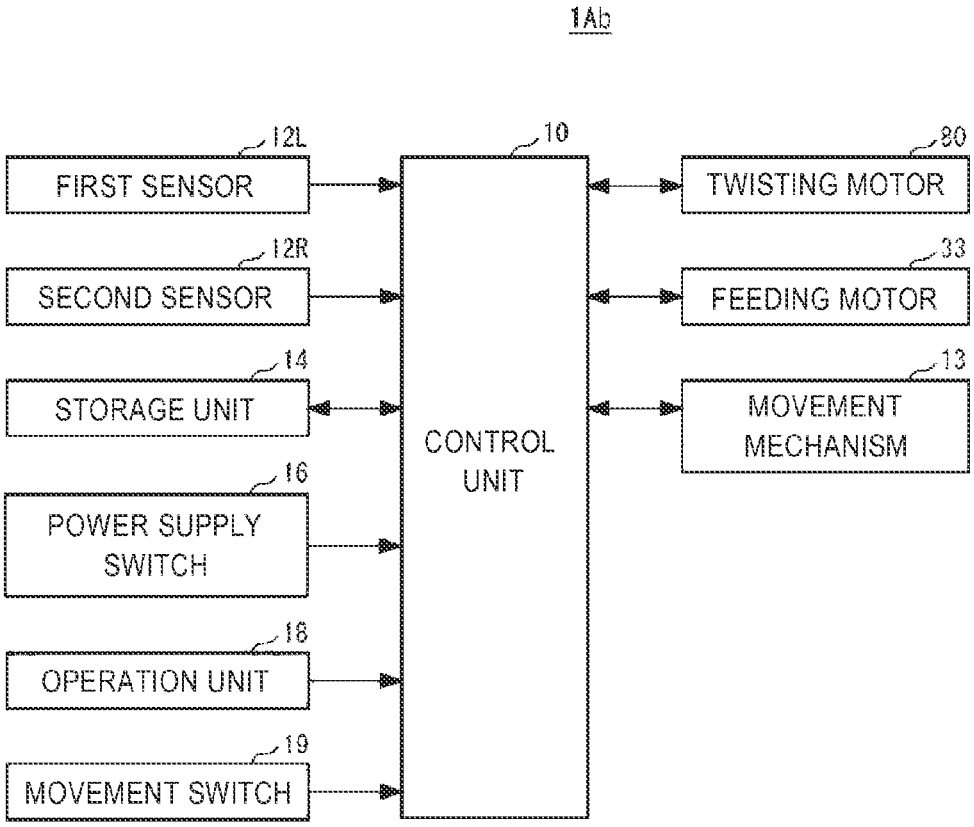
FIG. 12 is a block diagram showing a hardware configuration of a reinforced bar binding machine of a third modified embodiment.

FIG. 12 is a flowchart showing an example of a hardware configuration of a reinforced bar binding machine 1Ab. Note that, the constitutional elements having substantially the same functional configurations as the reinforced bar binding machine 1A of the first embodiment are denoted with the same reference signs, and the overlapping descriptions are omitted.

As shown in FIG. 12, the reinforced bar binding machine 1Ab includes the control unit 10, the first sensor 12L, the second sensor 12R, the storage unit 14, the power supply switch 16, the operation unit 18, a movement switch 19, the twisting motor 80, the feeding motor 33, and a movement mechanism 13. Note that, in the third modified embodiment, the regulation member 42 and the retreat mechanism 43 are not configured to operate in conjunction with the transmission member 44, and are instead configured to be independently movable between the first position and the second position by the movement mechanism 13.

The movement switch 19 is provided on at least one of the first main body part 301 and the second main body part 302, and is constituted by a well-known switch such as a push button, a slide switch, a seesaw switch or the like, fir example. When the movement switch 19 is operated by the operator, the movement switch 19 generates and outputs an operation signal to the control unit 10. The control unit 10 is configured to drive the movement mechanism 13 constituted by a solenoid or the like, for example, thereby moving the regulation member 42 and the retreat mechanism 43 to the second position. The retreat mechanism 43 and the like may also be configured to operate in conjunction with the transmission member 44, and to drive the twisting motor 80 by an operation of the movement switch 19, thereby moving the retreat mechanism 43 and the like via the transmission member 44.

Figure 13:
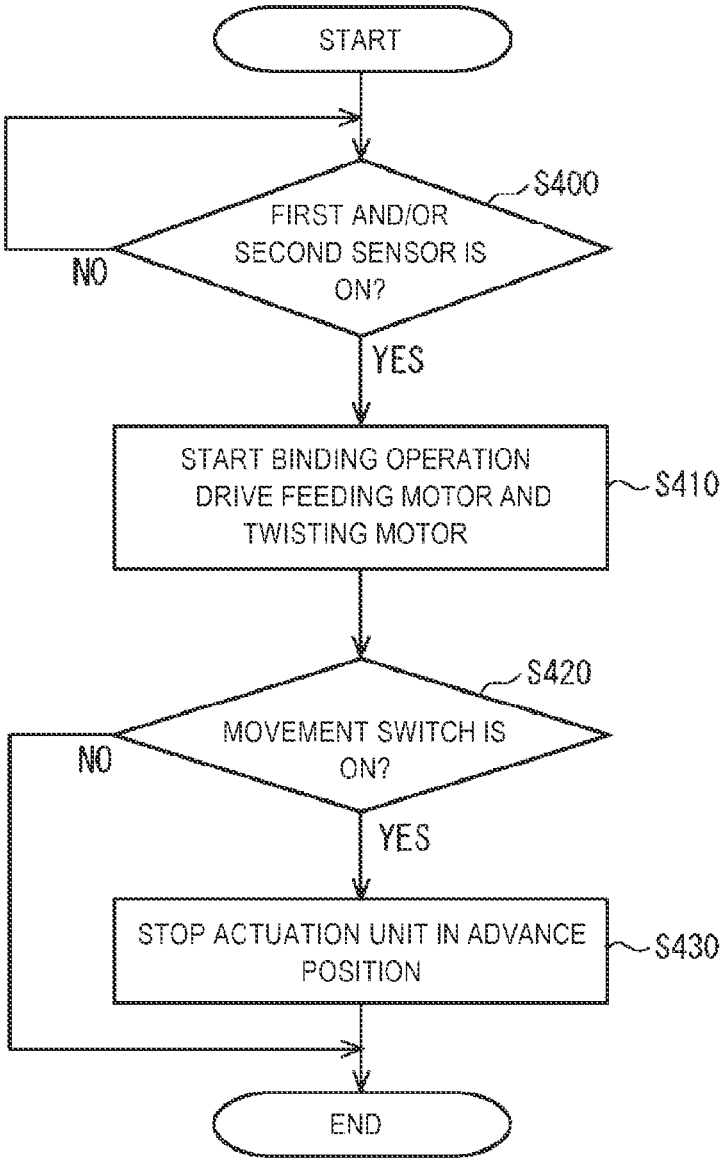
FIG. 13 is a flowchart showing an example of an operation of the reinforced bar binding machine of the third modified embodiment.

FIG. 13 is a flowchart showing an example of control of the reinforced bar binding machine 1Ab that is executed when the wire W is caught between the first guide 51 and the retreat mechanism 43. Note that, the detailed descriptions of the processing that is the same as or similar to the control described in FIG. 8 are omitted.

As shown in FIG. 13, in step S400, the control unit 10 determines whether an on-signal is supplied from the first sensor 12L and the like by an on-operation of the first contact member 9AL and the like. When the on-signal is supplied, the control unit 10 proceeds to step S410.

In step S410, the control unit 10 starts the binding operation. Thereby, the feeding of the wire W by the feeding unit 3A, and the gripping and twisting on the wire W by the twisting unit 7A are performed to bind the reinforced bars S with the wire W.

In step S420, the control unit 10 determines whether the movement switch 19 is turned on. For example, when jam of the wire W occurs after the binding operation starts, the operator operates the movement switch 19 so as to solve the jam. When it is determined that the movement switch 19 is turned on, the control unit 10 proceeds to step S430.

In step S430, the control unit 10 executes the first mode of driving the movement mechanism 13 to stop the actuation unit 71 in the advance position. Thereby, the regulation member 42 and the retreat mechanism 43 configured to operate in conjunction with the actuation unit 71 can be stopped in the second position spaced from the first guide 51. Note that, the movement switch 19 may be constituted by a mechanical switch, and when the movement switch 19 is operated by the operator, the regulation member 42 and the retreat mechanism 43 may be moved to the second position, irrespective of the determination by the control unit 10.

According to the third modified embodiment, for example, even when jam occurs between the first guide 51 and the retreat mechanism 43 during the binding operation, the retreat mechanism 43 can be moved to the second position by the operation of the movement switch 19. As a result, the wire W caught between the retreat mechanism 43 and the first guide 51 can be easily pulled out to solve the jam. Note that, the control of the third modified embodiment can also be applied to a case where the jam occurs on the gripping part 70 that is an example of the function unit 40.

Other Modified Embodiments

Note that, as for the control of moving the function unit 40 including the regulation member 42, the retreat mechanism 43 and the gripping part 70 to the second position, following controls can also be adopted, in addition to the first to third modified embodiments. Specifically, when the power supply switch 16 is turned on by the operator, the function unit 40 may be moved to the second position. In addition, the function unit 40 may be set to the first position as a default position, and when a predetermined time elapses, for example, although the function unit 40 is located in the first position at the time the power supply switch 16 is turned on, when a predetermined time elapses, the function unit 40 may be moved to the second position. Further, when a predetermined time elapses since the on-operation of the first contact member 9AL and the like, the function unit 40 may be moved to the second position. In this case, after the binding operation is over, when the on-operation of the first contact member 9AL and the like is not performed for a predetermined time, the function unit 40 may be moved to the second position.

Second Embodiment

Subsequently, a reinforced bar binding machine 1B of a second embodiment is described. Note that, the main configuration and the binding operation of the reinforced bar binding machine 1B of the second embodiment are common to the reinforced bar binding machine 1A of the first embodiment. For this reason, the constitutional elements having substantially the same functional configurations as the reinforced bar binding machine 1A of the first embodiment are denoted with the same reference signs, and the overlapping descriptions are omitted.

(Configuration Example of Reinforced Bar Binding Machine 1B)

Figure 14:
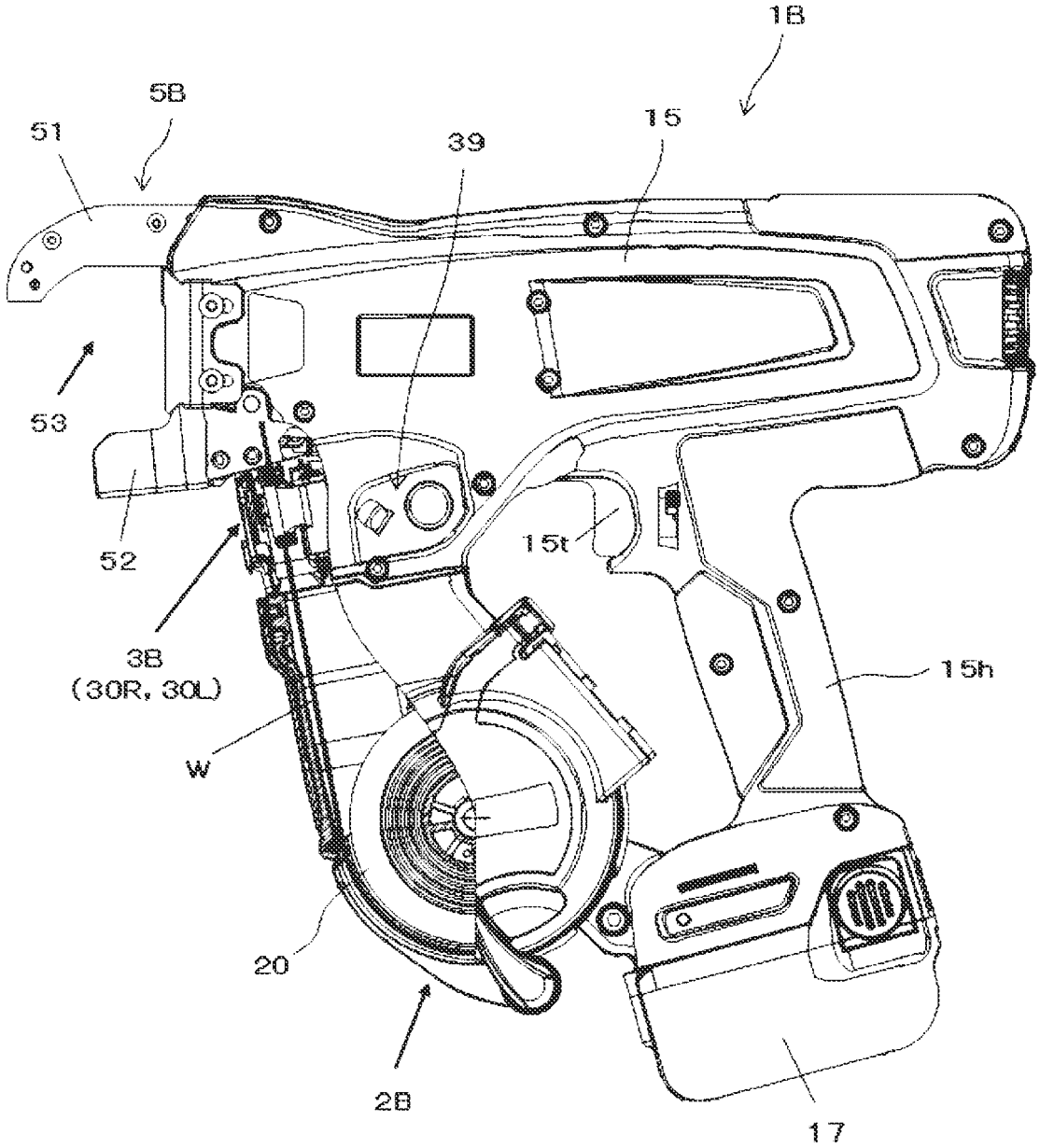
FIG. 14 is a perspective view of a reinforced bar binding machine of a second embodiment.
Figure 15:
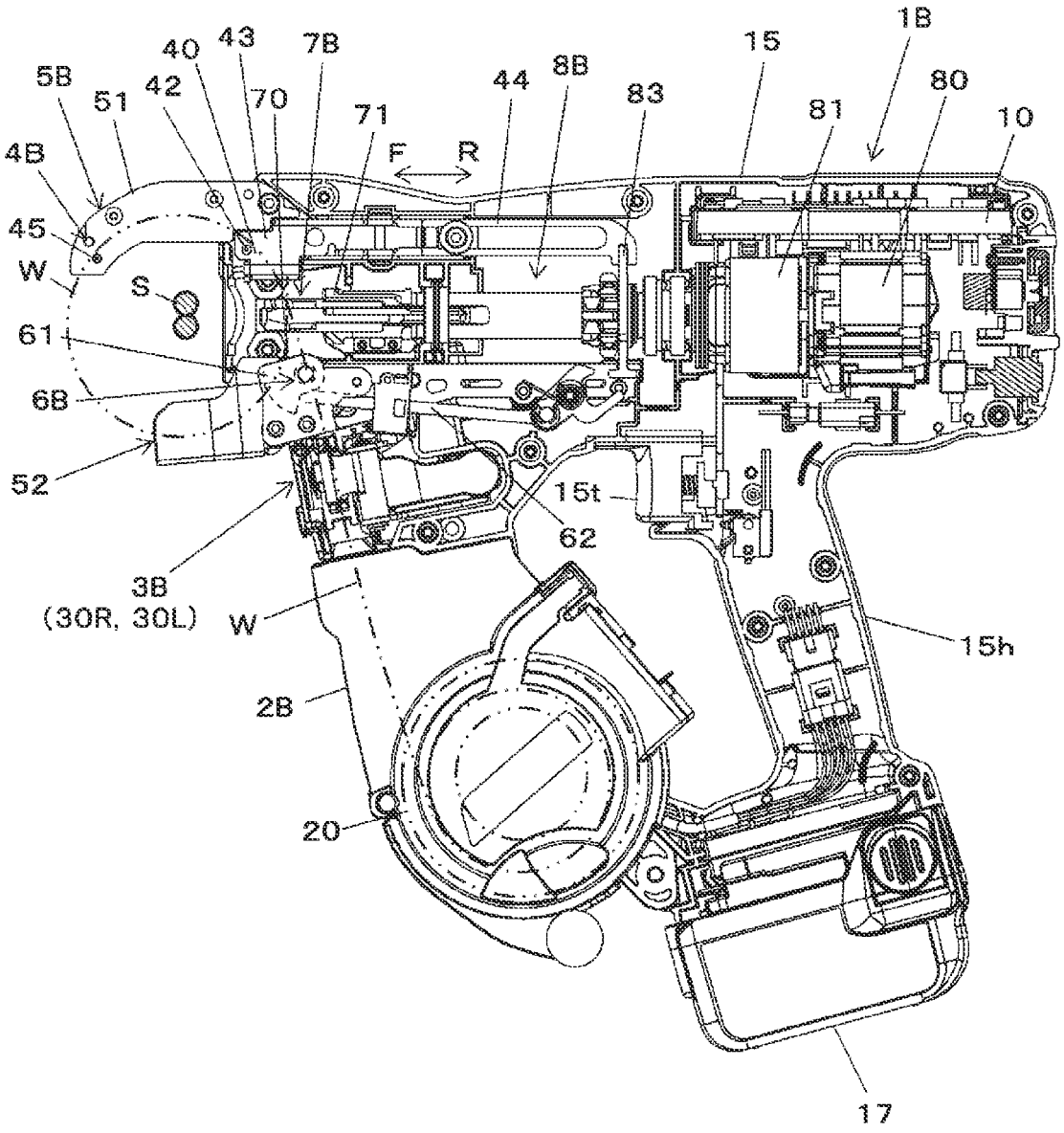
FIG. 15 is a side view showing an internal configuration of the reinforced bar binding machine of the second embodiment.

FIG. 14 is a perspective view of the reinforced bar binding machine 1B of the second embodiment, and FIG. 15 is a side view showing an internal configuration of the reinforced bar binding machine 1B of the second embodiment.

As shown in FIGS. 14 and 15, the reinforced bar binding machine 1B includes an accommodation part 2B in which a wire reel 20 having a wire W wound thereon is rotatably accommodated, and a feeding unit 3B configured to feed the wire W wound on the wire reel 20 accommodated in the accommodation part 2B. The reinforced bar binding machine 1B also has a regulation part 4B configured to curl the wire W that is fed by the feeding unit 3B, and a guide part 5B configured to guide the wire W curled by the regulation part 4B. The reinforced bar binding machine 1B also has a cutting unit 6B configured to cut the wire W, a twisting unit 7B configured to twist the wire W, and a drive unit 8B configured to drive the cutting unit 6B, the twisting unit 7B and the like.

A handle part 15*h* protrudes from the other side of a main body part 15 of the reinforced bar binding machine 1B. A battery 17 is detachably attached to a lower part of the handle part 15*h*. A front side of the handle part 15*h* is provided with a trigger 15*t* configured to receive an operation of actuating the reinforced bar binding machine 1B.

As shown in FIG. 15 and the like, the feeding unit 3B has a pair of first feeding gear 30L and second feeding gear 30R configured to feed the wire with clamping the wire by a rotation operation. The second feeding gear 30R of the feeding unit 3 is configured to be movable between a first position on a feeding locus of the wire W and a second position deviating from the feeding locus of the wire W.

As shown in FIG. 15 and the like, the function unit 40 has a regulation member 42 that constitutes the regulation part 4B, and a retreat mechanism 43 attached to the regulation member 42. The retreat mechanism 43 is connected to a transmission member 44 configured to operate in conjunction with a moving member 83 of the drive unit 8B, and is configured so that a position can vary with respect to the feeding locus of the wire W. Specifically, the regulation member 42 and the retreat mechanism 43 are located in a first position on the feeding locus of the wire W, in which they are in contact with the wire W, during operations of feeding the wire W in the forward direction by the feeding unit 3B and curling the wire W (refer to FIG. 6A). In addition, the regulation member 42 and the retreat mechanism 43 are moved to a second position deviating from the feeding locus of the wire W, in which they are not in contact with the wire W, before operations of feeding the wire W shown in FIG. 4C in the reverse direction and winding the wire W on the reinforced bars S (refer to FIG. 6B).

The twisting unit 7B is an example of the function unit 40, and has a gripping part 70 configured to grip the wire W and an actuation unit 71 configured to actuate the gripping part 70. The gripping part 70 includes hooks configured to open and close in conjunction with an operation of the actuation unit 71, and is configured to be movable between a first position in which the hooks are opened and a second position in which the hooks are closed.

(Example of Hardware Configuration of Reinforced Bar Binding Machine 1B)

Figure 16:
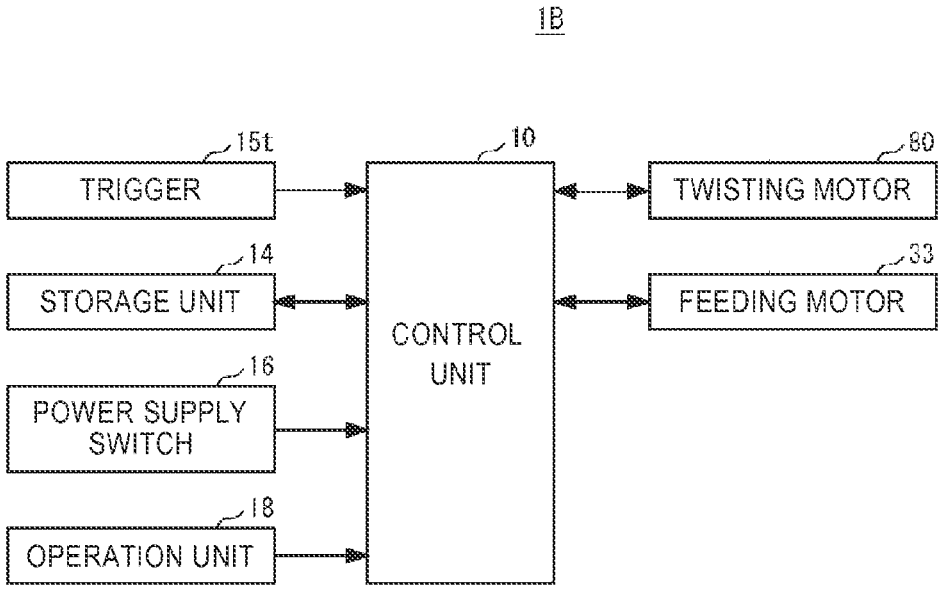
FIG. 16 is a block diagram showing a hardware configuration of the reinforced bar binding machine of the second embodiment.

FIG. 16 is a block diagram showing an example of a hardware configuration of the reinforced bar binding machine 1B. Note that, the constitutional elements having substantially the same functional configurations as the reinforced bar binding machine 1A of the first embodiment are denoted with the same reference signs, and the overlapping descriptions are omitted.

As shown in FIG. 16, the reinforced bar binding machine 1B includes the control unit 10, a trigger 151, the storage unit 14, the power supply switch 16, the operation unit 18, the twisting motor 80, and the feeding motor 33.

The trigger 15*t* includes a trigger switch. When the trigger is pulled by the operator, the trigger switch becomes on, so that an operation signal is output to the control unit 10. The control unit 10 is configured to drive the feeding motor 33 and the twisting motor 80 based on the operation signal supplied from the trigger 15*t*, thereby executing the binding operation.

(Example of Control of Reinforced Bar Binding Machine 1B)

Figure 17:
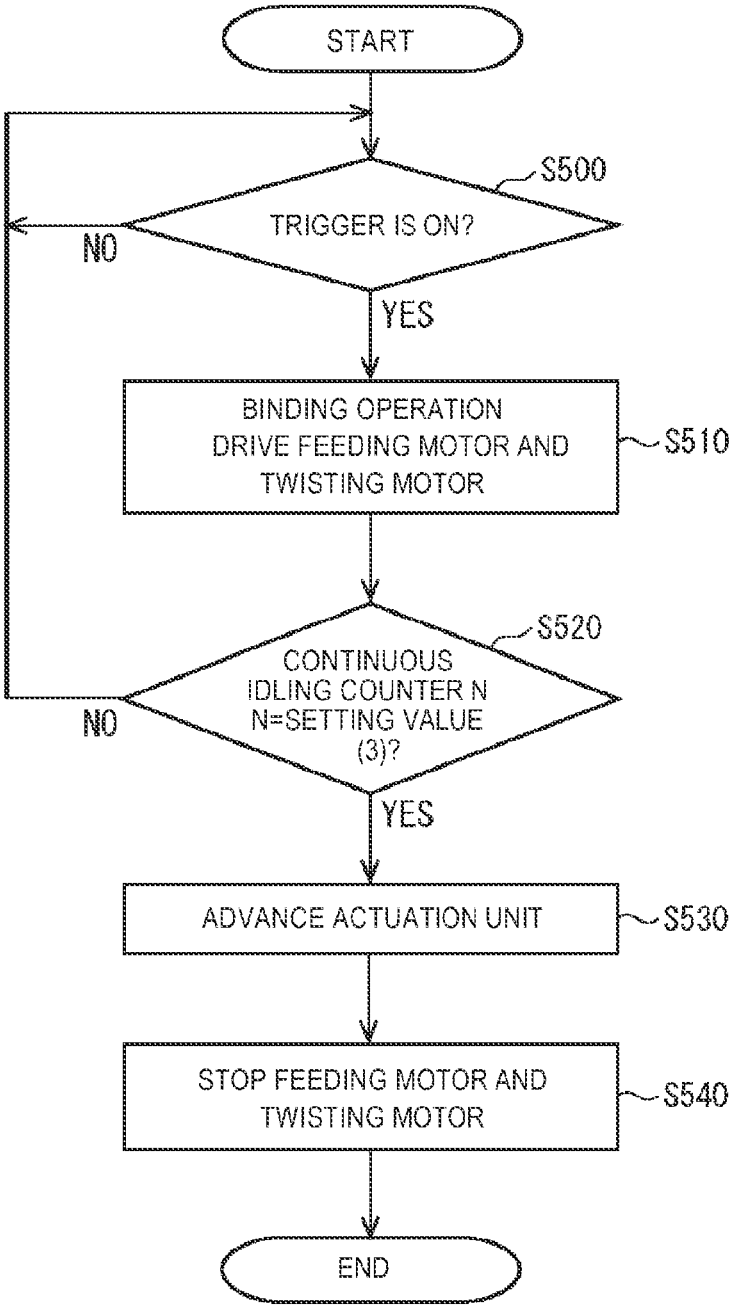
FIG. 17 is a flowchart showing an example of an operation of the reinforced bar binding machine of the second embodiment.

FIG. 17 is a flowchart showing an example of control of the reinforced bar binding machine 1B that is executed when the wire W is caught between the first guide 51 and the retreat mechanism 43. Note that, the detailed descriptions of the processing that is the same as or similar to the control described in FIG. 8 of the first embodiment are omitted.

First, when the operator confirms that the wire W is caught between the first guide 51 and the retreat mechanism 43, the operator operates the release lever 39. Thereby, the second feeding gear 30R is spaced from the first feeding gear 30L, so that the engagement between the first feeding gear 30L and the second feeding gear 30R is released.

Subsequently, as shown in FIG. 17, in step S500, the control unit 10 determines whether an operation signal based on an on-operation of the trigger 15*t* is input. When it is determined that the trigger 15*t* becomes on, the control unit 10 proceeds to step S510.

In step S510, the control unit 10 starts the binding operation. Specifically, the control unit 10 drives the feeding motor 33 and the twisting motor 80. At this time, since the engagement between the first feeding gear 30L and the second feeding gear 30R has been released, the wire W is in an idle feeding state, the load current of the feeding motor 33 does not increase, and the idle binding operation is executed. The control unit 10 determines that the wire W is not being normally feed, from an output result of the load current of the feeding motor 33, increments the continuous idling counter N (N=1), and stores a result thereof in the storage unit 14. When a series of idle binding operations are over, the control unit 10 stops the feeding motor 33 and the twisting motor 80. The actuation unit 71 and the like return to the initial positions.

In step S520, the control unit 10 determines whether the idle binding operation has been consecutively executed three times and the continuous idling counter N becomes 3 (N=3), for example. When it is determined that the continuous idling counter N is not 3 (N≠3), the control unit 10 returns to step S500, and executes the idle binding operation of steps S500 and S510.

On the other hand, when it is determined that the continuous idling counter N is 3 (N=3), the control unit 10 proceeds to step S530. In step S530, the control unit 10 drives the feeding motor 33 to rotate the first feeding gear 30L, and drives the twisting motor 80 to advance the actuation unit 71. As the actuation unit 71 is advanced, the regulation member 42 and the retreat mechanism 43 are moved from the first position to the second position.

In step S540, the control unit 10 stops the feeding motor 33 and stops the twisting motor 80 in the position to which the actuation unit 71 is advanced, thereby stopping the idle binding operation. Thereby, the regulation member 42 and the retreat mechanism 43 are stopped in the second position and the retreat mechanism 43 is spaced from the first guide 51, so that a gap is formed between the first guide 51 and the retreat mechanism 43.

Since the gap is formed between the first guide 51 and the retreat mechanism 43, the operator can easily remove the wire W caught at the first guide 51 or the like. When the operation of removing the wire W is over, the power supply switch 16 is turned off by the operator. When the power supply switch 16 is again turned on, the control unit 10 executes initialization of returning the actuation unit 71 and the like to the initial positions. Then, when the trigger 15*t* becomes on by the operator, the binding operation is resumed. Note that, the resumption of the binding operation is also implemented by control other than the turning on/off of the power supply switch 16.

Further, as the means for solving a situation where the poor feeding of the wire W occurs on the regulation part 4B, the control of the first to third modified embodiments can be applied by changing the on-operation of the first contact member 9AL and the like into the on-operation of the trigger 15*t*, in addition to the control shown in FIG. 17. Specifically, in the reinforced bar binding machine 1B, after the binding operation is over, the control shown in FIG. 9 of the first modified embodiment may be executed. That is, after the binding, the actuation unit 71 is stopped in the advanced position, so that the retreat mechanism 43 configured to operate in conjunction with the actuation unit 71 is stopped in the second position. In addition, the control shown in FIG. 11 of the second modified embodiment may be executed. That is, the jam detection sensor 11 is provided, and when jam occurs, the retreat mechanism 43 is moved to the second position. Further, the control shown in FIG. 13 of the third modified embodiment may be executed. That is, the movement switch 19 configured to move the retreat mechanism 43 is provided, and when the poor feeding of the wire W occurs, the retreat mechanism 43 is moved to the second position by operating the movement switch 19. In addition, the control of the first to third modified embodiments can be applied when jam occurs on the gripping part 70 having the hooks.

Although the preferred embodiments of the present disclosure have been described with reference to the accompanying drawings, the technical scope of the present disclosure is not limited thereto. One skilled in the art of the present disclosure can conceive a variety of changes or modifications within the technical spirit defined in the claims, and the changes or modifications are included within the technical scope of the present disclosure.

What is claimed is:

1. A binding machine comprising:

a wire feeder that feeds a wire and winds the wire around a to-be-bound object;

a wire twister that twists the wire wound around the to-be-bound object so as to bind the to-be-bound object, a wire guide that is movable between a first position located on a feeding locus of the wire and a second position deviating from a position on the feeding locus of the wire, wherein the wire guide contacts the wire, and a controller configured to control movement of the wire guide between the first position and the second position, wherein the wire guide is in the first position when the wire is fed, and the wire guide is in the second position when the wire is wound around the to-be-bound object, wherein the controller is further configured to control positioning of the wire guide so that the wire guide is located and stopped in the second position in a predetermined state, and wherein the predetermined state is after the to-be-bound object is bound by the wire.

2. The binding machine according to claim 1, wherein the controller determines whether a feeding state of the wire by the wire feeder is an idle feeding state, wherein the predetermined state is a case where the controller determines that a feeding state of the wire by the feeding unit is an idle feeding state, and wherein the controller moves the wire guide from the first position to the second position in the predetermined state.

3. The binding machine according to claim 1, wherein the binding machine includes a feeding motor and a twisting motor, and wherein the controller is configured to stop the feeding motor and the twisting motor with the wire guide stopped in the second position.

4. A binding machine comprising:

a wire feeder that feeds a wire and winds the wire around a to-be-bound object;

a wire twister that twists the wire wound around the to-be-bound object so as to bind the to-be-bound object, a wire guide that is movable between a first position located on a feeding locus of the wire and a second position deviating from a position on the feeding locus of the wire, wherein the wire guide contacts the wire, and a controller configured to control movement of the wire guide between the first position and the second position, wherein the wire guide is in the first position when the wire is fed, and the wire guide is in the second position when the wire is wound around the to-be-bound object, wherein the controller is further configured to control positioning of the wire guide so that the wire guide is located and stopped in the second position in a predetermined state, wherein the controller is configured to detect a feeding state of the wire, wherein the predetermined state is a case where poor feeding of the wire is detected by the controller, and wherein the controller moves the wire guide from the first position to the second position in the predetermined state.

5. A binding machine comprising:

a wire feeder that feeds a wire and winds the wire around a to-be-bound object;

a wire twister that twists the wire wound around the to-be-bound object so as to bind the to-be-bound object, a wire guide that is movable between a first position located on a feeding locus of the wire and a second position deviating from a position on the feeding locus of the wire, wherein the wire guide contacts the wire, and a controller configured to control movement of the wire guide between the first position and the second position, wherein the wire guide is in the first position when the wire is fed, and the wire guide is in the second position when the wire is wound around the to-be-bound object, wherein the controller is further configured to control positioning of the wire guide so that the wire guide is located and stopped in the second position in a predetermined state, the binding machine further comprises a switch configured to move the wire guide from the first position to the second position, wherein the predetermined state is a case where the switch is operated.

6. A binding machine comprising:

a wire feeder that feeds a wire and winds the wire around a to-be-bound object;

a wire twister that twists the wire wound around the to-be-bound object so as to bind the to-be-bound object, a wire guide that is movable between a first position located on a feeding locus of the wire and a second position deviating from a position on the feeding locus of the wire, wherein the wire guide contacts the wire, and a controller configured to control movement of the wire guide between the first position and the second position, wherein the wire guide is in the first position when the wire is fed, and the wire guide is in the second position when the wire is wound around the to-be-bound object, wherein the controller is further configured to control positioning of the wire guide so that the wire guide is located and stopped in the second position in a predetermined state, wherein the controller is configured to be selectively set in a first mode or a second mode, the first mode being a mode in which the controller moves the wire guide to the first position after the to-be-bound object is bound by the wire, and the second mode being a mode in which the controller moves the wire guide to the second position after the to-be-bound object is bound by the wire, wherein the predetermined state is a case where the controller is set in the second mode and the to-be-bound object is bound by the wire.

* * * * *